US011617443B1

(12) United States Patent
Levin

(10) Patent No.: US 11,617,443 B1
(45) Date of Patent: Apr. 4, 2023

(54) HINGE, HINGE SYSTEM FOR A CHAIR, RETROFIT KIT FOR A CHAIR, CHAIR, BOAT CHAIR, AND/OR A MULTIPLE IN-USE POSITION CHAIR

(71) Applicant: Eric Martin Levin, Severna Park, MD (US)

(72) Inventor: Eric Martin Levin, Severna Park, MD (US)

( * ) Notice: Subject to any disclaimer, the term of this patent is extended or adjusted under 35 U.S.C. 154(b) by 120 days.

(21) Appl. No.: 17/199,938

(22) Filed: Mar. 12, 2021

(51) Int. Cl.
*A47C 4/04* (2006.01)
*A47C 7/40* (2006.01)
*B63B 29/04* (2006.01)

(52) U.S. Cl.
CPC ..... *A47C 4/04* (2013.01); *A47C 7/407* (2013.01); *B63B 29/04* (2013.01); *B63B 2029/043* (2013.01)

(58) Field of Classification Search
CPC ..... A47C 4/04; A47C 7/407; B63B 29/04; B63B 2029/043
USPC ..... 297/378.1
See application file for complete search history.

(56) References Cited

U.S. PATENT DOCUMENTS 2,702,909 A * 3/1955 Atkins ..... A47C 20/043 482/142
2015/0176640 A1* 6/2015 Serocki ..... B60N 2/24 16/333

FOREIGN PATENT DOCUMENTS

CN 202154626 * 3/2012
DE 102013009865 * 10/2012
WO WO2014032372 * 3/2014

* cited by examiner

*Primary Examiner* — Mark R Wendell
(74) *Attorney, Agent, or Firm* — Garcia-Zamor Intellectual Property Law, LLC; Ruy Garcia-Zamor

(57) ABSTRACT

A chair add-on, a chair, a chair modification, a chair hinge, and/or a hinge system that may be used to provide enhanced seating comfort to users. It is preferred, but not necessary, that the chair add-on, the chair, the chair modification, the chair hinge, and/or the hinge system is easy to use by users of all ages.

20 Claims, 20 Drawing Sheets

HINGE, HINGE SYSTEM FOR A CHAIR, RETROFIT KIT FOR A CHAIR, CHAIR, BOAT CHAIR, AND/OR A MULTIPLE IN-USE POSITION CHAIR

BACKGROUND

The present invention is generally directed to mechanical bearings and, more specifically, to hinges for connecting two objects. More specifically still, the invention is directed toward a multi-positional, spring-locking hinge system, and a chair making use of such system.

Typical folding chairs used on boats and in various other contexts include a pivoting hinge that only allows two positions for the backrest relative to the seat rest, closed for storage and open for use. The closed position is where the backrest is substantially parallel and parallel with the seat rest. The other of these positions is an open position where the backrest is positioned for a user to sit on the chair. Typical folding chairs are uncomfortable and useable at best for one task.

Therefore, it may be advantageous to provide any one of: a chair add-on, a chair, a chair modification, a chair hinge, and/or a hinge system; each of which may preferably: be multi-positional, use spring-locking hinge system; have increased comfort; may be more efficient to manufacture; may be manufactured as part of a chair; may be manufactured as part of a folding chair; may be manufactured as part of a chair retrofit kit, and/or may be used in other arrangements or devices.

SUMMARY

Briefly speaking, one embodiment of the present invention is directed to a hinge system. The hinge system may comprise a first hinge housing. The first hinge housing may further define a first hole and may be configured to be disposed on a chair seat frame. The first hole may form a first, keyed receptacle. The hinge system may also comprise a rod which is detachably engageable with the first hinge housing. The rod may be configured to have a chair back frame disposed thereon. The rod may be configured to define an axis of rotation about which the chair back frame and the chair seat frame move relative to each other. The hinge system may further comprise a first, keyed component disposed on the rod. The first, keyed component may be configured to detachably engage a first, keyed receptacle. The hinge system may comprise a biasing member positioned on the rod. The biasing member may be configured to drive the rod axially toward the first hinge housing such that the first, keyed component may be biased toward engagement with the first, keyed receptacle. The biasing member may be moved between a first, biased position, in which the first, keyed component can be driven toward engagement with the first, keyed receptacle, and a second, compressed position, in which the first, keyed component can be driven toward disengagement with the first, keyed receptacle. The first, keyed component and the first, keyed receptacle may be configured so that the rod can be secured to the first hinge housing in a plurality of angular positions, as measured in a cross-section taken perpendicular to the longitudinal axis. The hinge system may be configured so as to secure the chair back frame in any one of multiple in-use positions relative to the chair seat frame such that a user can vary an angle of reclination for sitting thereon.

In a separate embodiment, the present invention is directed to a hinge system. The hinge system may comprise a first hinge housing. The first hinge housing may further define a rotation chamber. The rotation chamber may be contained at least partially within the first hinge housing. The rotation chamber may allow free rotation of the first, keyed component to the any one of multiple in-use positions when the biasing member is in the second, compressed position.

In a separate embodiment, the present invention is directed to a hinge system. The hinge system may comprise a first hinge housing and a second hinge housing. The second hinge housing may define a second hole. The second hinge housing may be configured to be disposed on the chair seat frame. The second hole may form a second, keyed receptacle. The hinge system may comprise a rod which is detachably engageable with the first hinge housing and the second hinge housing. The rod may be configured to have a chair back frame disposed thereon. The rod may be configured to define an axis of rotation about which the chair back frame and the chair seat frame move relative to each other. The second, keyed component may be disposed on the rod which is configured to detachably engage the second, keyed receptacle. A biasing member may be moved between the first, biased position, in which the second, keyed component can be driven toward engagement with the second, keyed receptacle, and the second, compressed position, in which the second, keyed component can be driven toward disengagement with the second, keyed receptacle.

In a separate embodiment, the present invention is directed to a hinge system. The hinge system may comprise a first hinge housing. The first hinge housing may further define a rotation chamber. The rotation chamber may be contained at least partially within the first hinge housing. The rotation chamber may allow free rotation of the first, keyed component to the any one of multiple in-use positions when the biasing member is in the second, compressed position. The first housing may completely enclose the rotation chamber. The rotation chamber may be configured to be located axially between the first, keyed receptacle and a closest axial end of the chair seat frame.

In a separate embodiment, the present invention is directed to a hinge system. The hinge system may comprise a knob. The knob may be attached to a distal end of a rod. The knob may allow the user to convert the biasing member from the first, biased position to the second, compressed position. The knob may also allow the user to rotate the rod to the any one of multiple in-use positions.

In a separate embodiment, the present invention is directed to a hinge system. The hinge system may comprise a first hinge housing. The first hinge housing may further define a first hole and may be configured to be disposed on a chair seat frame. The first hole may form a first, keyed receptacle. The hinge system may also comprise a rod which is detachably engageable with the first hinge housing. The rod may be configured to have a chair back frame disposed thereon. The rod may be configured to define an axis of rotation about which the chair back frame and the chair seat frame move relative to each other. The rod may also form the first, keyed component.

In a separate embodiment, the present invention is directed to a hinge system. The hinge system may comprise a first hinge housing. The first hinge housing may further define a first hole and may be configured to be disposed on a chair seat frame. The first hole may form a first, keyed receptacle. The hinge system may also comprise a rod which is detachably engageable with the first hinge housing. The rod may be configured to have a chair back frame disposed thereon. The rod may be configured to define an axis of rotation about which the chair back frame and the chair seat frame move relative to each other. The hinge system may further comprise a first, keyed component disposed on the rod. The first, keyed component may be configured to detachably engage the first, keyed receptacle. The first keyed component may be selected from a group consisting of a nut, a spline shaft, a gear, a ratchet, a keyed shape, or the like.

In a separate embodiment, the present invention is directed to a hinge system. The hinge system may comprise a first hinge housing. The first hinge housing may further define a first hole and may be configured to be disposed on a chair seat frame. The first hole may form a first, keyed receptacle. The hinge system may also comprise a rod which is detachably engageable with the first hinge housing. The rod may be configured to have a chair back frame disposed thereon. The rod may be configured to define an axis of rotation about which the chair back frame and the chair seat frame move relative to each other. The hinge system may further comprise a first, keyed component disposed on the rod. The first, keyed component may be configured to detachably engage the first, keyed receptacle. The first, keyed receptacle may be selected from a group consisting of a socket, a spline hub, a gear housing, a pawl, a keyed shape, or the like.

In a separate embodiment, the present invention is directed to a hinge system. The hinge system may comprise a first hinge housing and a second hinge housing. The second hinge housing may define a second hole. The second hinge housing may be configured to be disposed on the chair seat frame. The second hole may form a second, keyed receptacle. The hinge system may comprise a rod which is detachably engageable with the first hinge housing and the second hinge housing. The rod may be configured to have a chair back frame disposed thereon. The rod may be configured to define an axis of rotation about which the chair back frame and the chair seat frame move relative to each other. The hinge system may further comprise an elongated housing disposed between the first hinge housing and the second hinge housing. The elongated housing may be cylindrical. The elongated housing may at least partially enclose the rod.

In a separate embodiment, the present invention is directed to a hinge system. The hinge system may comprise a biasing member positioned on the rod. The biasing member may be configured to drive the rod axially toward the first hinge housing and the second hinge housing such that the first, keyed component and the second, keyed component may be biased toward engagement with the first, keyed receptacle and the second, keyed receptacle, respectively. The biasing member may be moved between a first, biased position, in which the first, keyed component and the second, keyed component can be driven toward engagement with the first, keyed receptacle and the second, keyed receptacle, respectively, and a second, compressed position, in which the first, keyed component and the second, keyed component can be driven toward disengagement with the first, keyed receptacle and the second, keyed receptacle, respectively. The biasing member may comprise a first biasing member and a second biasing member. The first biasing member may have a first biasing axial end positioned adjacent to the first, keyed receptacle. The second biasing member may have a second biasing axial end positioned adjacent to the second, keyed receptacle.

In a separate embodiment, the present invention is directed to a hinge system. The hinge system may comprise a first hinge housing and a second hinge housing. The second hinge housing may be configured to be disposed on the chair seat frame. The hinge system may comprise a rod which is detachably engageable with the first hinge housing and the second hinge housing. The rod may be configured to have a chair back frame disposed thereon. The rod may be configured to define an axis of rotation about which the chair back frame and the chair seat frame move relative to each other. The hinge system may further comprise an elongated housing disposed between the first hinge housing and the second hinge housing. The elongated housing may at least partially enclose the rod. The elongated housing may define at least one slot configured to allow passage of a chair back frame connector therethrough.

In a separate embodiment, the present invention is directed to a hinge system. The hinge system may comprise a knob. The knob may be attached to a distal end of a rod. The knob may allow a user to convert a biasing member from a first, biased position to a second, compressed position. The knob may also allow the user to rotate the rod to the any one of multiple in-use positions. The biasing member may be located between the knob and the first hinge housing.

In a separate embodiment, the present invention is directed to a hinge system. The hinge system may be used in a folding chair to connect a chair back to a chair seat or a chair body or freestanding chair. The hinge may allow relative motion between the chair back and the chair seat.

In a separate embodiment, the present invention is directed to a hinge system. The hinge system may comprise a housing. The housing may define a hole. The hole may form a keyed receptacle. The hinge system may also comprise a rod. The rod may exist partially within the hole. The rod may have a keyed component disposed thereon. The hinge system may comprise a biasing member. The biasing member may drive the keyed component into engagement with the keyed receptacle. The rod may be rotatable. The housing may be disposed on a chair seat. A chair back may be disposed on the rod. The rotation of the rod may allow for relative movement between the chair back and the chair seat.

In a separate embodiment, the present invention is directed to a chair. The chair may comprise a chair back frame and a chair seat frame. The chair may comprise a first hinge housing. The first hinge housing may further define a first hole and may be configured to be disposed on the chair seat frame. The first hole may form a first, keyed receptacle. The chair may also comprise a rod which is detachably engageable with the first hinge housing. The rod may be configured to have the chair back frame disposed thereon. The rod may be configured to define an axis of rotation about which the chair back frame and the chair seat frame move relative to each other. The chair may further comprise a first, keyed component disposed on the rod. The first, keyed component may be configured to detachably engage the first, keyed receptacle. The chair may comprise a biasing member positioned on the rod. The biasing member may be configured to drive the rod axially toward the first hinge housing such that the first, keyed component may be biased toward engagement with the first, keyed receptacle. The biasing member may be moved between a first, biased position, in which the first, keyed component can be driven toward engagement with the first, keyed receptacle, and a second, compressed position, in which the first, keyed component can driven toward disengagement with the first, keyed receptacle. The first, keyed component and the first, keyed receptacle may be configured so that the rod can be secured to the first hinge housing in a plurality of angular positions, as measured in a cross-section taken perpendicular to the longitudinal axis. The hinge system may be configured so as to secure the chair back frame in any one of multiple in-use positions relative to the chair seat frame such that a user can vary an angle of reclination for sitting thereon.

In a separate embodiment, the present invention is directed to a chair. The chair may comprise a chair back frame and a chair seat frame. The chair may comprise a first hinge housing and a second hinge housing. The second hinge housing may define a second hole. The second hinge housing may be configured to be disposed on the chair seat frame. The second hole may form a second, keyed receptacle. The chair may comprise a rod which is detachably engageable with the first hinge housing and the second hinge housing. The rod may be configured to have the chair back frame disposed thereon. The rod may be configured to define an axis of rotation about which the chair back frame and the chair seat frame move relative to each other. The second, keyed component may be disposed on the rod which is configured to detachably engage the second, keyed receptacle. A biasing member may be moved between the first, biased position, in which the second, keyed component can be driven toward engagement with the second, keyed receptacle, and the second, compressed position, in which the second, keyed component can be driven toward disengagement with the second, keyed receptacle.

In a separate embodiment, the present invention is directed to a chair. The chair may comprise a hinge system. The chair may further comprise a chair back frame and a chair seat frame. The hinge system may be used in the chair to connect the chair back frame to the chair seat frame. The hinge may allow relative motion between the chair back frame and the chair seat frame.

In a separate embodiment, the present invention is directed to a chair. The chair may comprise a chair back frame and the chair seat frame. The chair may further comprise a hinge system. The hinge system may comprise a housing. The housing may define a hole. The hole may form a keyed receptacle. The hinge system may also comprise a rod. The rod may exist partially within the hole. The rod may have a keyed component disposed thereon. The hinge system may comprise a biasing member. The biasing member may drive the keyed component into engagement with the keyed receptacle. The rod may be rotatable. The housing may be disposed on a chair seat. A chair back may be disposed on the rod. The rotation of the rod may allow for relative movement between the chair back and the chair seat.

In a separate embodiment, the present invention is directed to a chair. The chair may comprise a chair back frame and a chair seat frame. The chair may also comprise a multi-positional, spring-locking hinge system. The multi-positional, spring-locking hinge system may be operated by a user in order to secure the chair back frame in any one of multiple in-use positions relative to the chair seat frame such that the user can vary an angle of reclination for sitting thereon.

In a separate embodiment, the present invention is directed to a chair. The chair may comprise a chair back frame and a chair seat frame. The chair may also comprise a multi-positional, spring-locking hinge system. The chair may be used in many configurations to increase the number of situations in which the chair is easy to use, including, but not limited to: on a boat, in a park, at a stadium, on other vehicles, and at a movie theater.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. It is understood, however, that the invention is not limited to the precise arrangements and instrumentalities shown. In the drawings.

Figure 1:
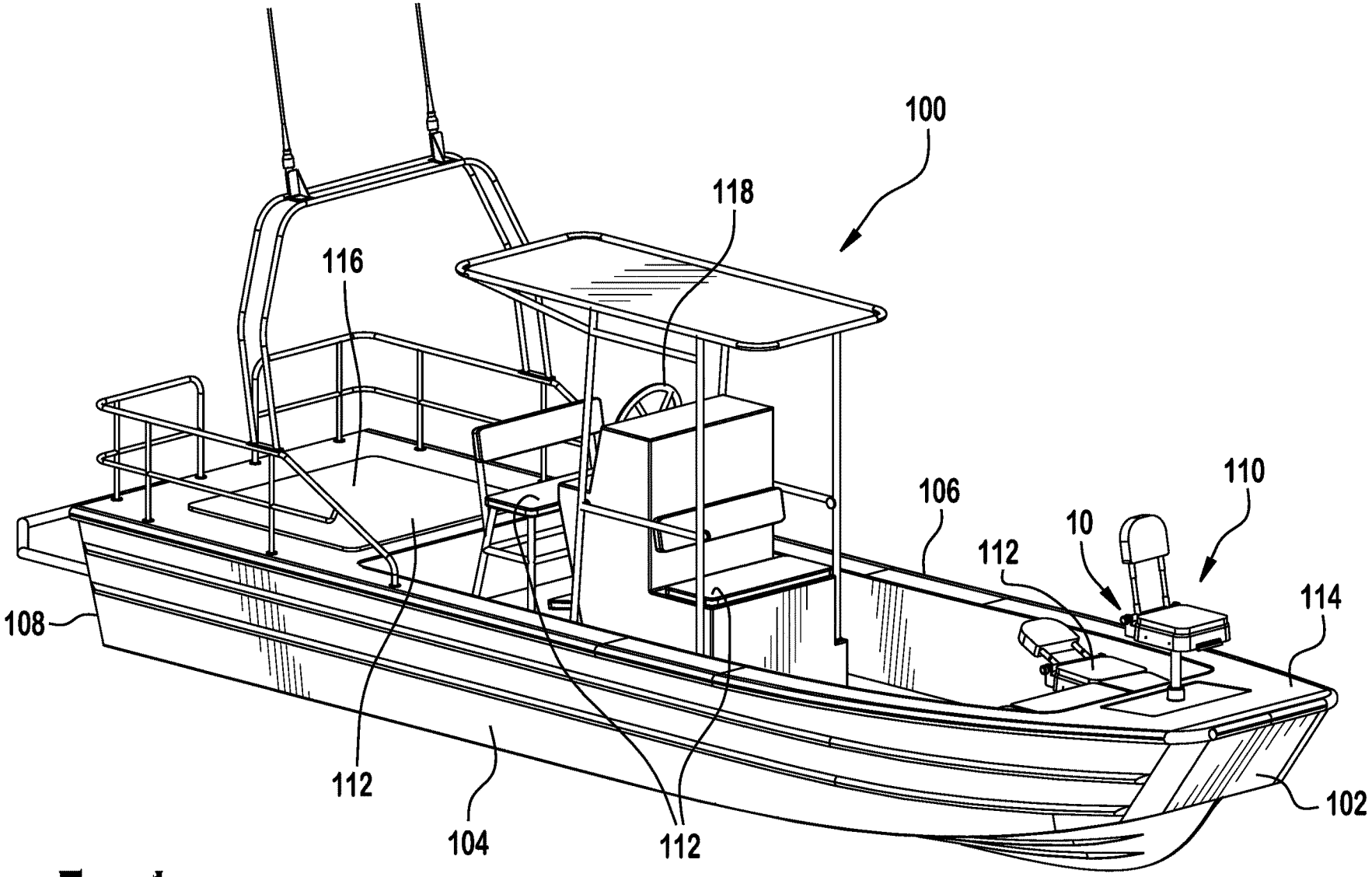
FIG. 1 is a front perspective view of a chair 110 in the preferred embodiment shown in use with a boat 100. The chair 110, as depicted, is shown connected to the front deck 114 of the boat 100. The front deck 114 is located above the bow 102 and between the starboard side 104 and the port side 106. The boat 100 further comprises a rear deck 116 located above the stern 108 and between the starboard side 104 and the port side 106. The chair 110 can be located at any one of the chair locations 112: including, but not limited to: behind the ship's wheel 118, on the lower deck 120, in front of the ship's wheel 118, and on the rear deck 116. The chair 110 comprises a chair back frame 26 and a chair seat frame 34. The chair further comprises a hinge system 10 that allows for rotation of the chair back frame 26 relative to the chair seat frame 34.

Here, the biasing member 44 comprises a first biasing member 122 and a second biasing member 124. The first biasing member 122 has a first biasing axial end 123 positioned adjacent to the first, keyed receptacle 16. The second biasing member 124 has a second biasing axial end 125 positioned adjacent to the second, keyed receptacle 60. The first biasing member 122 is also partially axially overlapped by the knob 70.

DETAILED DESCRIPTION OF THE PREFERRED EMBODIMENT

Certain terminology is used in the following description for convenience only and is not limiting. The words "right," "left," "up," and "down" designate the directions as they would be understood by a person facing in the viewing direction unless specified otherwise. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. The words "outer" and "inner" refer to directions away from and toward, respectively, the geometric center of the specified element, or, if no part is specified, the geometric center of the hinge system 10. The terms "downward" and "upward refers to directions above and below the chair seat frame 34, respectively, unless specified otherwise. The terms "forward" and "front" refer to a direction in front of the hinge system 10, or the chair 110, and the term "rear" refers to a direction behind the hinge system 10, or the chair 110. The terms "axial" and "radial" refer to directions along the rod 24 and around the rod 24, respectively. The terms "touching," "abutting," "against," and "contacting" when used in connection with two surfaces is defined as meaning "being positioned anywhere between actual touching of two surfaces to being in facing orientation and within 1 inch (or 2.54 centimeters) apart." Those of ordinary skill in the art will appreciate from this disclosure that skill in the art will appreciate from this disclosure that when a range is provided such as (for example) an angle/distance/number/weight/volume/spacing being between one (1 of the appropriate unit) and ten (10 of the appropriate units) that specific support is provided by the specification to identify any number within the range as being disclosed for use with a preferred embodiment. For example, the recitation of a percentage of copper between one percent (1%) and twenty percent (20%) provides specific support for a preferred embodiment having two point three percent (2.3%) copper even if not separately listed herein and thus provides support for claiming a preferred embodiment having two point three percent (2.3%) copper. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." More specifically, the language 'at least two/three of the following list' (the list itemizing items '1', '2', '3', '4', etc.), as used in the claims, means at least two/three total items selected from the list and does not mean two/three of each item in the list. The term "in-use position," as used in the claims and corresponding portions of the specification, means "a configuration of the chair in which it is suitable for sitting." As such, if there is a storage position in which the chair is not meant for sitting (such as when the chair back frame is folded onto and over the chair seat frame) it would not qualify as an in-use position. The term "interior", as used in the claims and corresponding portions of the specification means the area proximate to the center of the invention. The term "exterior" similarly defines the area not in proximity to the center of the invention. Additionally, the words "a" and "one" are defined as including one or more of the referenced items unless specifically stated otherwise. The terminology includes the words specifically mentioned above, derivatives thereof, and words of similar import.

Referring generally to FIGS. 1-32, wherein like numerals indicate like elements throughout, a hinge system 10 is disclosed in its preferred embodiment. Preferably, the hinge system 10 may be used with a chair 110 to allow a chair back frame 26 of the chair 110 to be secured in any one of multiple in-use positions 92 relative to a chair seat frame 34 of the chair 110 so that a user may be able to select a desired angle of reclination. The alternative preferred embodiment of the chair 110 is also disclosed. The chair 110 may comprise the hinge system 10 or at least the elements of the hinge system 10. One of ordinary skill in the pertinent art would appreciate from this disclosure, however, that the hinge system 10 may be used with a variety of other devices and apparatuses that require the rotational, locking, and other functionality provided by the hinge system 10 without departing from the scope of the present invention.

Referring now to FIG. 1, a chair 110 of the preferred embodiment is shown as configured for use with a boat 100. The chair 110 may comprise a chair back frame 26 and a chair seat frame 34 that are connected by a hinge system 10. The chair 110 may be located at any one of the various chair locations 112 on the boat 100. The boat 100 may define a bow 102, a starboard side 104, a port side 106, and a stern 108. The boat 100 may further define a front deck 114 above the bow 102 and between the starboard side 104 and the port side 106. The boat 100 may further define a rear deck 116 located above the stern 108 and between the starboard side 104 and the port side 106. The chair 110 may be permanently affixed, or removably attached, to the boat 100 and located at any one of the chair locations 112: including, but not limited to: behind the ship's wheel 118, on a lower deck 120, in front of a ship's wheel 118, and on the rear deck 116. One of ordinary skill in the art would appreciate from this disclosure that the chair 110 may be located anywhere on the boat 100, or anywhere on other vehicles, venues, places, buildings, or other places that seating may be desired, without departing from the scope of the present invention.

Figure 2:
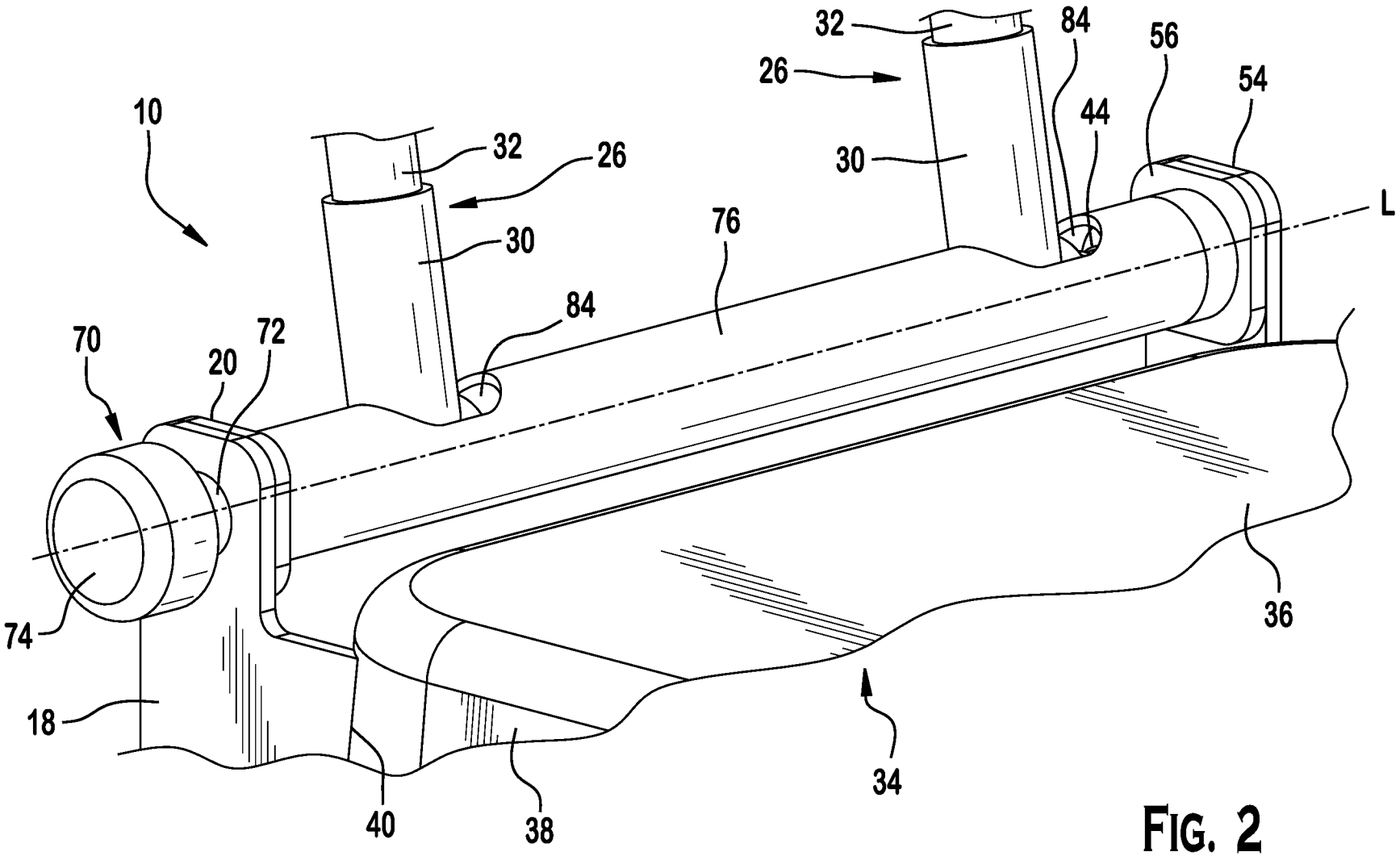
FIG. 2 is a partial front perspective view of a hinge system 10 in the preferred embodiment shown in use with a chair 110. This figure illustrates a first hinge housing 12 and a second hinge housing 52 connected to a chair seat frame 34. The chair seat frame 34 may comprise a chair seat portion 36 where a user may sit on the chair 110. The chair seat frame 34 may further comprise a chair seat side 38. The first hinge housing 12 and the second hinge housing 52 comprise a first housing frame 18 and a second housing frame 54, respectively. One edge of the first housing frame 18 may form a seat housing connection 40. The first housing frame 18 and the second housing frame 54 each comprise flattened, L-shaped plates that connect at seat housing connections 42 to the chair seat frame 34. The first hinge housing 12 and the second hinge housing 52 further comprise a first housing structure 20 and a second housing structure 56, respectively. A knob 70 is connected at one side of the first hinge housing 12. The knob 70 also comprises a user portion 74 that allows a user of the hinge system 10 to grasp the knob 70 and engage the hinge system 10. The first hinge housing 12 and the second hinge housing 52 are axially spaced from one another, and an elongated housing 76 stretches therebetween. A biasing member 44 can be seen located within the elongated housing 76. The elongated housing 76 comprises at least one slot 78. The at least one slot 78 allows the chair back frame 26 to protrude from it. The chair back frame 26 comprises a chair back support 30 protruding from the at least one slot 78 connected to a chair back post 32. The elongated housing 76 contains an inner space 84.

Referring now to FIG. 2, a hinge system 10 of the preferred embodiment of the present invention is shown. The hinge system 10 may comprise a first hinge housing 12. The first hinge housing 12 may comprise a first housing frame 18 and a first housing structure 20. The first housing frame 18 may be flat, plate-like, and L-shaped. One edge of the first housing frame 18 may form a seat housing connection 40. The first housing structure 20 may be flat and plate-like at one end and be permanently affixed to the first housing frame 18. The seat housing connection 40 may be the portion of the first hinge housing 12 that is connectedly attached to a chair seat frame 34. The chair seat frame 34 may comprise a chair seat portion 36 where a user may sit on the chair 110. The chair seat frame 34 may further comprise a chair seat side 38. The chair seat side 38 may be configured to connectedly attach to the hinge system 10 via the first hinge housing 12 at the seat housing connection 40.

Referring still to FIG. 2, the hinge system 10 may further comprise a second hinge housing 52. The second hinge housing 52 may comprise a second housing frame 54 and a second housing structure 56. The second housing frame 54 may be flat, plate-like, and L-shaped. The second housing structure 56 may be flat and plate-like at one end and be permanently affixed to the second housing frame 54. The first hinge housing 12 and the second hinge housing 52 may be formed of steel or high-strength polymer. However, one of ordinary skill in the art would appreciate from this disclosure that the first hinge housing 12 and the second hinge housing 52 may be formed or constructed of any suitably strong, durable, wear-resistant materials as required to support the hinge system 10 without departing from the scope of the present invention.

One of ordinary skill in the pertinent art would also appreciate from this disclosure that the first hinge housing 12 and the second hinge housing 52 as herein described may be exchanged, switched, or substituted for one another as required or necessitated by any relevant design constraints without departing from the scope of the present invention.

Figure 3:
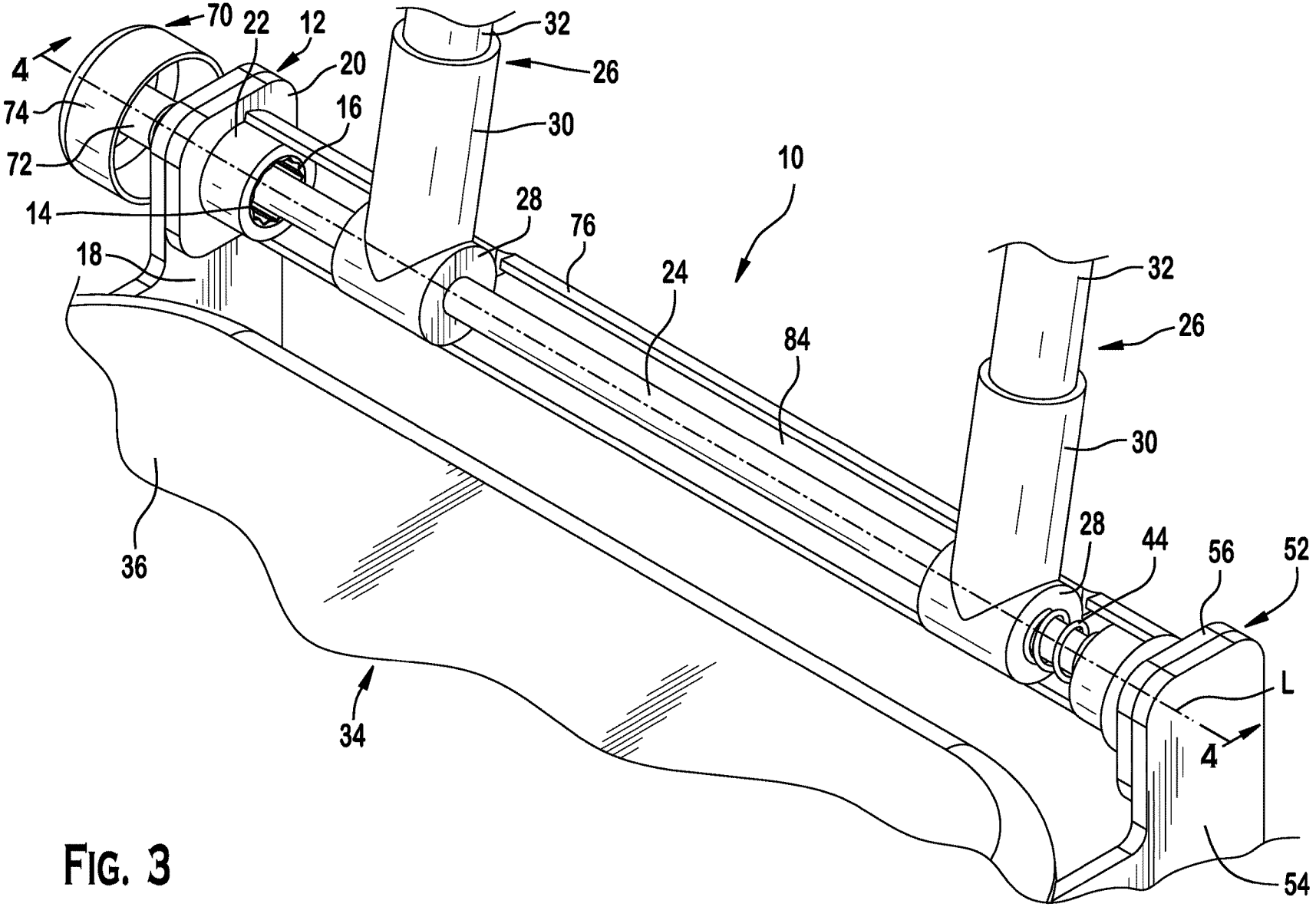
FIG. 3 is a partial, cut-away front perspective view of a hinge system 10 in the preferred embodiment shown in use with the chair 110. This figure illustrates a first hinge housing 12 and a second hinge housing 52 connected to a chair seat frame 34. The first hinge housing 12 and the second hinge housing 52 comprise a first housing frame 18 and a second housing frame 54, respectively. The first hinge housing 12 and the second hinge housing 52 further comprise a first housing structure 20 and a second housing structure 56, respectively. The first housing structure 20 comprises a first tube portion 22. The first tube portion 22 defines a first hole 14. The first hole 14 forms a first, keyed receptacle 16. The second housing structure 56 comprises a second tube portion 64. A rod 24 is located along a longitudinal axis L. The rod 24 spans the axial distance between the first hinge housing 12 and the second hinge housing 52. The chair back frame 26 comprises a chair back connector 28 that is permanently affixed to the rod 24. The rod 24 is at least partially enclosed by the elongated housing 76. A biasing member 44 can be seen located within the elongated housing 76 and circumferentially surrounding a portion of the rod 24. The biasing member 44 is seen in a first, biased position 46.

Referring now to FIG. 3 of the preferred embodiment of the present invention, the first housing structure 20 may comprise a first tube portion 22. Together, the first housing frame 18 and the first housing structure 20 may define a first hole 14 therethrough. The first hole 14 may extend through the first tube portion 22 and may form a first, keyed receptacle 16 therein. The first, keyed receptacle 16 may be a socket, a spline hub, a gear housing, a pawl, or the like. The second housing structure 56 may further comprise a second tube portion 64. Together, the second housing frame 54 and the second housing structure 54 may define a second hole 58 therethrough. The second hole 58 may extend through the second tube portion 64 and may form a second, keyed receptacle 60 therein. The second, keyed receptacle 60 may be a socket, a spline hub, a gear housing, a pawl, or the like. One of ordinary skill in the art would appreciate from this disclosure that the first, keyed receptacle 16 and the second, keyed receptacle 60 may be any suitable, locking components designed to engage with a corresponding suitable, keyed locking component without departing from the scope of the present invention.

Referring still to FIG. 3, the hinge system 10 may comprise a rod 24 that extends axially between the first hinge housing 12 and the second hinge housing 52. The rod 24 may define a longitudinal axis L that runs in an axial direction centered along the rod 24. The rod 24 may be configured to have a chair back frame 26 disposed thereon. The chair back frame 26 may comprise a chair back connector 28. The chair back connector 28 may be T-shaped to connect to the rod 24 at one end. The opposite end of the chair back connector 28 may comprise a chair back support 30 which may be tubular and engage with a chair back post 32. The chair back frame 26 may extend radially away from the rod 24. The rod 24 may extend through the first hole 14 and the second hole 58. The rod 24 may have a distal end 68 designed to be connected to a knob 70. The distal end 68 may extend into and connect to a rod attachment portion 72 of the knob 70.

Still referring to FIG. 3 of the preferred embodiment of the present invention, the hinge system 10 may comprise an elongated housing 76. The elongated housing 76 may define at least one slot 78. The at least one slot 78 may allow the chair back frame 26 to extend therethrough. The elongated housing 76 may be tubular, may axially extend between the first hinge housing 12 and the second hinge housing 52, and may at least partially enclose the rod 24. "At least partially enclosing the rod 24" preferably means that the elongated housing 76, except for the at least one slot 78, radially surrounds at least fifty percent (50%) of the rod 24. More preferably, "at least partially enclosing the rod 24" means that the elongated housing 76, except for the at least one slot 78, radially surrounds at least seventy-five percent (75%) of the rod 24. More preferably still, "at least partially enclosing the rod 24" means that the elongated housing 76, except for the at least one slot 78, radially surrounds at least ninety percent (90%) of the rod 24. Most preferably, "at least partially enclosing the rod 24" means that the elongated housing 76, except for the at least one slot 78, completely radially surrounds the rod 24. One of ordinary skill in the art would appreciate that the elongated housing 76 may axially abut or axially overlap the first tube portion 22 and the second tube portion 64 without departing from the scope of the present invention.

Figure 4:
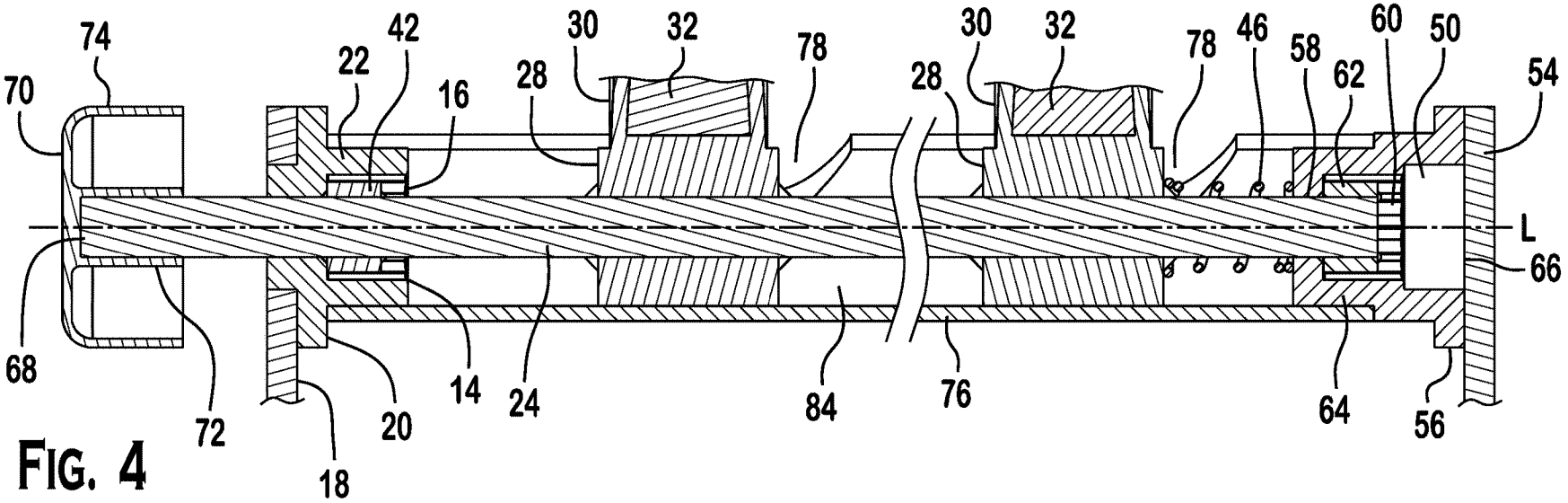
FIG. 4 is a front cross-sectional view of a hinge system 10 in the preferred embodiment. Here, the rod 24 can be seen spanning the axial distance between the first hinge housing 12 and the second hinge housing 52. The rod includes a distal end 68. The distal end 68 is connected to a knob 70. The knob 70 comprises a rod attachment portion 72 that abutting the contacts the distal end 68 of the rod 24. The knob 70 also comprises a user portion 74 that allows a user of the hinge system 10 to grasp the knob 70 and engage the hinge system 10. A first, keyed component 42 connected to the rod 24 can be seen engaged with the first, keyed receptacle 16. The second tube portion 64 defines a second hole 58. The second hole 58 forms a second, keyed receptacle 60. A second, keyed component 62 connected to the rod 24 can be seen engaged with the second, keyed receptacle 60. The biasing member 44 can be seen in a first, biased position 46. The biasing member 44 in the first, biased position 46 creates the automatic engagement of the first, keyed component 42 with the first, keyed receptacle 16 and the second, keyed component 62 with the second, keyed receptacle 60. A rotation chamber 50 can be seen contained within the second hinge housing 52. The rotation chamber 50 is located axially between the second, keyed receptacle 60 and a closest axial end 66 of the second housing frame 54. The rotation chamber 50 has a diameter strictly greater than the diameter of the second, keyed component 62.

Referring now to FIG. 4 of the present invention, the hinge system 10 may comprise a first, keyed component 42 and a second keyed, component 62 disposed along the rod 24. The first, keyed component 42 and the second, keyed component 62 may be a nut, a spline shaft, a gear, or a ratchet. One of ordinary skill in the art would appreciate from this disclosure that the first, keyed component 42 and the second, keyed component 62 may be any suitable, male locking components designed to engage with a corresponding suitable, female locking component without departing from the scope of the present invention.

Still referring to FIG. 4, the hinge system 10 may further comprise a biasing member 44. The biasing member 44 may axially overlap and radially surround the rod 24. The biasing member 44 may be located radially between the rod 24 and the elongated housing 76. The biasing member may be in an inner space 84 defined by the elongated housing 76. In the preferred embodiment, the biasing member 44 is located axially between the chair back connector 28 and the second tube portion 64. The biasing member 44 is shown in a first, biased position 46. When the biasing member 44 is in the first, biased position 46, the first, keyed component 42 and the second, keyed component 62 may be automatically biased into a rotationally-locked engagement with the first, keyed receptacle 16 and the second, keyed receptacle 60, respectively. The biasing member 44 may provide force for the aforementioned engagement without influence from a source external to the present invention.

Still referring to FIG. 4, the first hinge housing 12 and the second hinge housing 52 may define a rotation chamber 50. The rotation chamber 50 may be at least partially contained within the second hinge housing 52. The rotation chamber 50 may be located axially between the second, keyed receptacle 60 and a closest axial end 66 of the second housing frame 54. The rotation chamber 50 being at least partially contained with the second hinge housing 52 preferably means that the rotation chamber 50 may be at least fifty percent (50%) contained within the second hinge housing 52. More preferably, the rotation chamber 50 being at least partially contained with the second hinge housing 52 means that the rotation chamber 50 may be at least seventy-five percent (75%) contained within the second hinge housing 52. More preferably still, the rotation chamber 50 being at least partially contained with the second hinge housing 52 means that the rotation chamber 50 may be at least ninety percent (90%) contained within the second hinge housing 52. Most preferably, the rotation chamber 50 being at least partially contained with the second hinge housing 52 means that the rotation chamber 50 may be fully contained within the second hinge housing 50.

Figure 5:
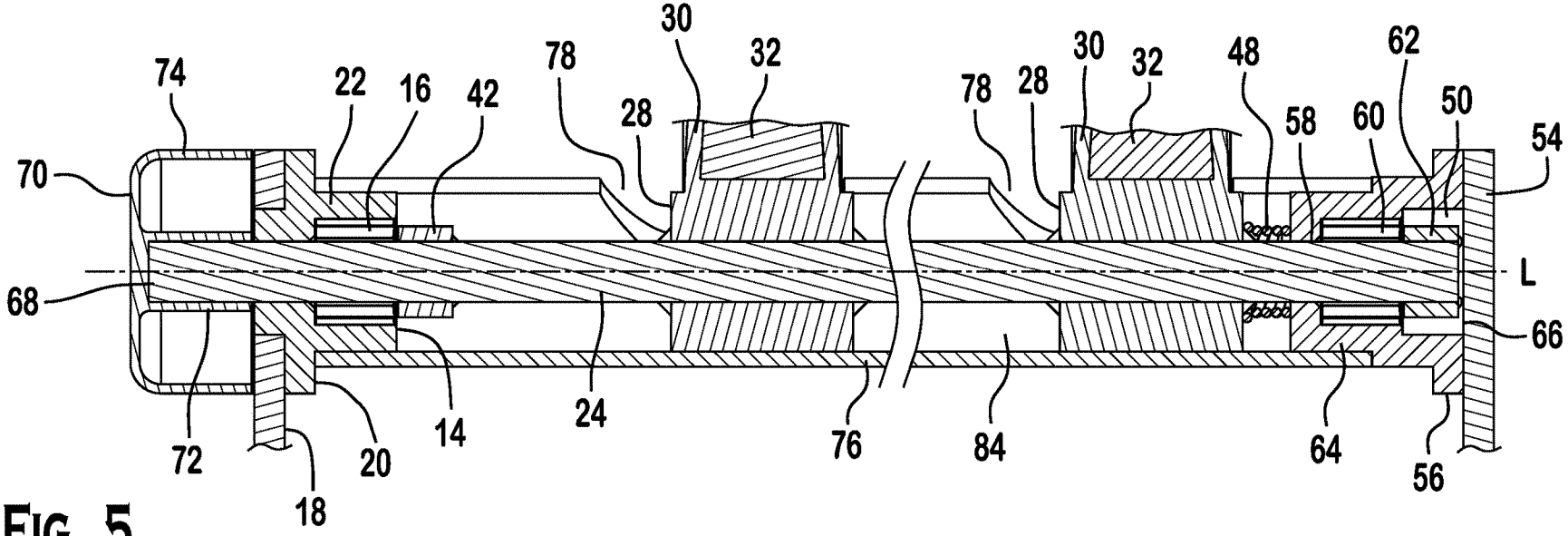
FIG. 5 is a front cross-sectional view of a hinge system 10 in the preferred embodiment. Here, the biasing member 44 can be seen in a second, compressed position 48. The biasing member 44 may be converted to the second, compressed position 48 when a user exerts a force on the knob 70 in a direction parallel to the longitudinal axis L. Alternatively, the user may pull the knob 70 outwardly away from the cent of the rod 24 along the longitudinal axis to allow the chair back frame to rotate relative to the chair seat frame. The first, keyed component 42 is disengaged with the first, keyed receptacle 16 and is located within the inner space 84. The second, keyed component 62 is disengaged with the second, keyed receptacle 60 and is located within the rotation chamber 50.

Referring now to FIG. 5 of the preferred embodiment of the present invention, the biasing member 44 is shown in a second, compressed position 48. Here, a user of the present invention may have acted upon and applied a force to the knob 70 in a direction parallel to the longitudinal axis L thereby moving the rod 24 in the axial direction. The rod 24 may slide through the first hole 14 and the second hole 58. The rod 24 may be axially displaced from where the rod 24 lies when the biasing member 44 is in the first, biased position 46. Due to this axial displacement of the rod 24, the first, keyed component 42 and the second, keyed component 62 are disengaged from and drawn out of the first, keyed receptacle 16 and the second, keyed receptacle 60, respectively.

Referring still to FIG. 5, the first, keyed component 42 and the second, keyed component 62 may be disengaged from the first, keyed receptacle 16 and the second, keyed receptacle 60, respectively. Due to the axial displacement of the rod 24, the first, keyed component 42 may now be located within the inner space 84. Since the inner space 84 may have a diameter greater than the first, keyed component 42, the first, keyed component 42 may not be in a locked position of engagement with the first, keyed receptacle 16, and the rod 24 may be able to freely rotate. Further, due to the axial displacement of the rod 24, the second, keyed component 62 may now be located within the rotation chamber 50. Since the rotation chamber 50 may have a diameter greater than the second, keyed component 62, the second, keyed component 62 may not be in a locked position of engagement with the second, keyed receptacle 60, and the rod 24 may be able to freely rotate. While the various embodiments of the present invention illustrate the first keyed, receptacle and the first keyed component pair ("first locking pair") being generally the same (albeit with a different orientation) as the second keyed, receptacle and second the second keyed component pair ("second locking pair"), those of ordinary skill in the art will appreciate from this disclosure that the first and second locking pairs may have different relative size without departing from the scope of the present invention. For example the second keyed receptacle could have double the diameter (or be sized as any other multiple or fraction) of the first keyed receptacle. Additionally, those of ordinary skill in the art will appreciate from this disclosure that the first and second locking pairs may have different configurations without departing from the scope of the present invention.

Referring still to FIG. 5, the chair back frame 26 may also be axially displaced due to the axial sliding and displacement of the rod 24. The chair back frame 26 may be permanently affixed to the rod 24 via the chair back connector 26. For the axial displacement of the chair back frame 24 to be accommodated by the elongated housing 76, the at least one slot 78 in the elongated housing 76 may have an axial distance at least as great as the possible axial displacement of the chair back connector 26 to allow free movement and sliding along the longitudinal axis L.

Figure 6:
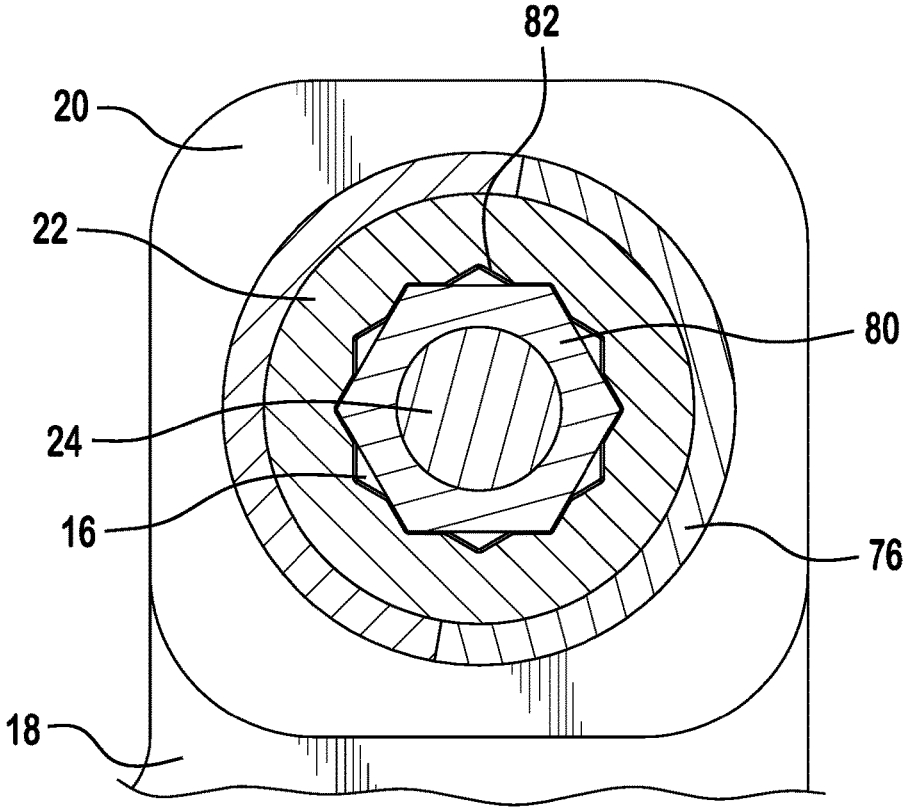
FIG. 6 is a side cross-sectional view of a hinge system 10 in the preferred embodiment. This figure illustrates the first, keyed receptacle 16 of the first hinge housing 12. Here, it can be seen that the first, keyed component 42 is disengaged with the first, keyed receptacle 16. The first, keyed component 42 comprises a nut 80 and the first, keyed receptacle 16 comprises a socket 82. The nut 80 is disengaged with the socket 82 because the sides 96 of the nut 80 are misaligned with the inner walls 98 of the socket 82.

Referring now to FIG. 6 of the preferred embodiment of the present invention, the first hinge housing 12 is shown with the first, keyed component 42 engaged with first, keyed receptacle 16. The first, keyed component 42 may be a nut 80 as shown in the FIG. 6. The first, keyed receptacle 16 may be a socket 82 as shown in FIG. 6. Those of ordinary skill in the art will appreciate from this disclosure that the first keyed component 42 and the first keyed receptacle 16 can have any configuration which allows for detachable connections in one or more rotational positions relative to each other without departing from the scope of the present invention. The same is true of the second keyed component and the second keyed receptacle. The first tube portion 22 may define the first, keyed receptacle 16. The nut 80 may be attached to the rod 24 and may be in any one of multiple in-use positions 92. Here, the nut 80 is shown in one such in-use position with the socket 82. Sides of the nut 96 may abuttingly contact socket inner walls 98 to keep the nut 80 firmly locked into engagement with the socket 82.

Figure 7:
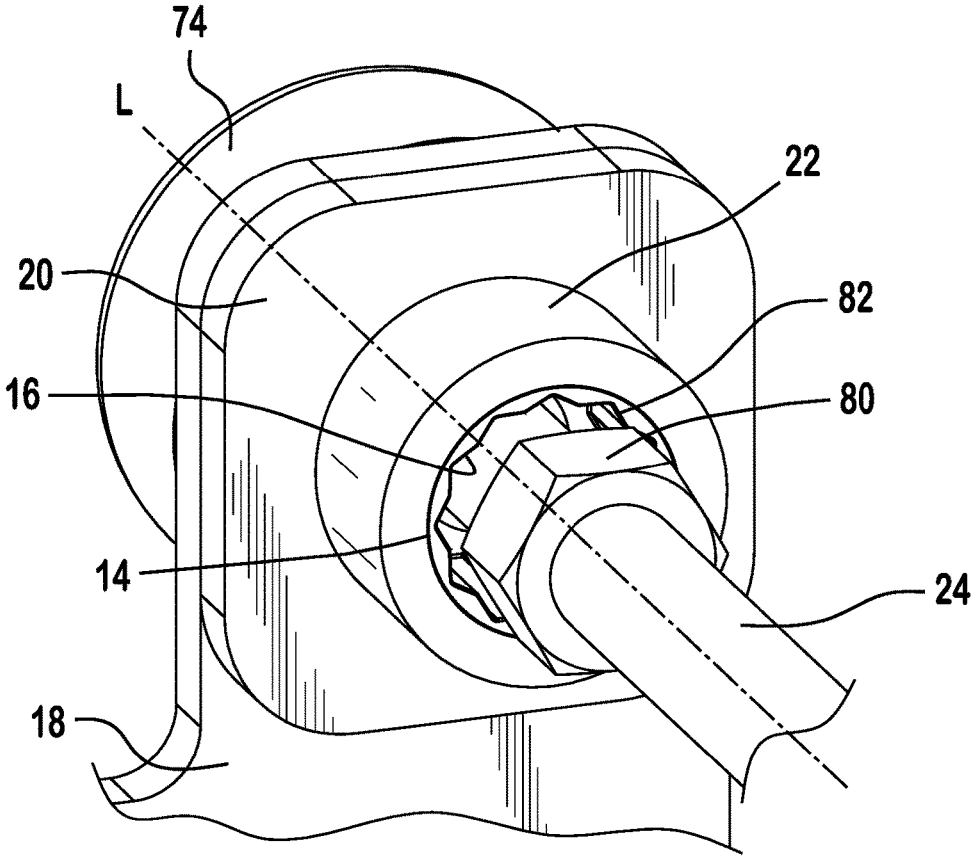
FIG. 7 is a partial perspective view of a first hinge housing 12 in the preferred embodiment. Here, it can be seen that the first, keyed component 42 comprising a nut 80 is disengaged with the first, keyed receptacle 16 comprising a socket 82. The knob 70 can be seen opposite the nut 80 and the socket 82 across the first hinge housing 12. The nut 80 may be rotated along with the rod 24 by a user twisting the knob 70 and realigning the sides 96 of the nut 80 with the inner walls 98 of the socket 82.

Referring now to FIG. 7 of the preferred embodiment of the present invention, the first hinge housing 12 is shown with the first, keyed component 42 disengaged with first, keyed receptacle 16. The sides of the nut 96 may not axially overlap the socket inner walls 98 when the nut 80 is disengaged with the socket 82. In this position of disengagement, a user of the hinge system 10 may physically engage the knob 70 via the user portion 74 and freely rotate the rod 24 to any one of multiple in-use positions 92. The knob 70, the first, keyed receptacle 16, the first, keyed component 42, and the rod 24 may all remain radially symmetrical about the longitudinal axis L at all times of axial sliding and rotation.

Figure 8:
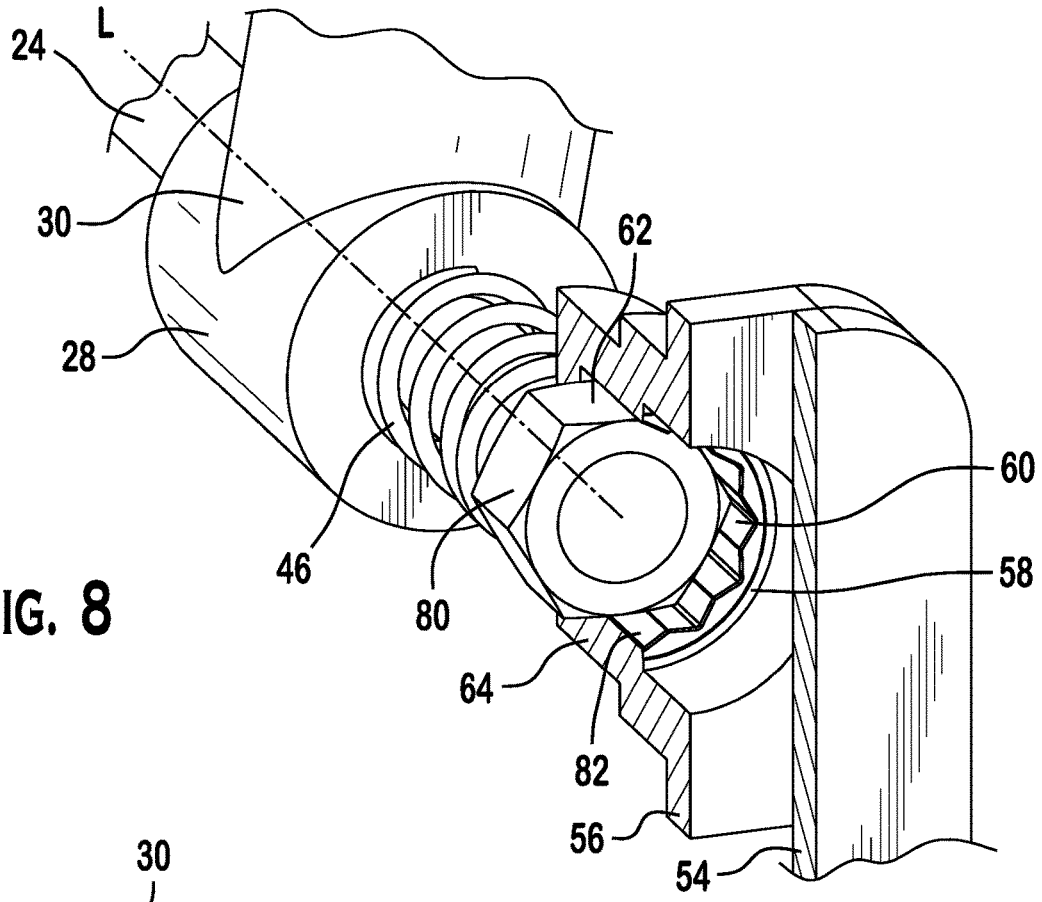
FIG. 8 is a partial, cut-away side perspective view of a second hinge housing 52 in the preferred embodiment. This figure illustrates the biasing member 44 surrounding the rod 24 and located between the chair back connector 28 of the chair back frame 26 and the second tube portion 64 of the second housing structure 56. The biasing member 44 is shown in the first, biased position 46. When the biasing member 44 is in the first, biased position 46, the second, keyed component 62 comprising a nut 80 is substantially withdrawn into engagement with the second, keyed receptacle 60 comprising a socket 82. In this configuration, the second, keyed component 62 does not extend into the rotation chamber 50.

Referring now to FIG. 8 of the present invention, the hinge system 10 may comprise a biasing member 44. The biasing member 44 may axially overlap and radially surround the rod 24. In the preferred embodiment, the biasing member 44 is located axially between the chair back connector 28 and the second tube portion 64. The biasing member 44 is shown in a first, biased position 46. When the biasing member 44 is in the first, biased position 46, the second, keyed component 62 comprising a nut 80 may be automatically biased into a rotationally-locked engagement with the second, keyed receptacle 60 comprising a socket 82. Those of ordinary skill in the art will appreciate from this disclosure that the biasing member is not limited to the shape shown and could be an actuator, solenoid, battery powered switch, gear driven mechanism or the like without departing from the scope of the present invention. Additionally, those of ordinary skill in the art will appreciate from this disclosure that the hinge assembly can include more than one biasing member without departing from the scope of the present invention.

Figure 9:
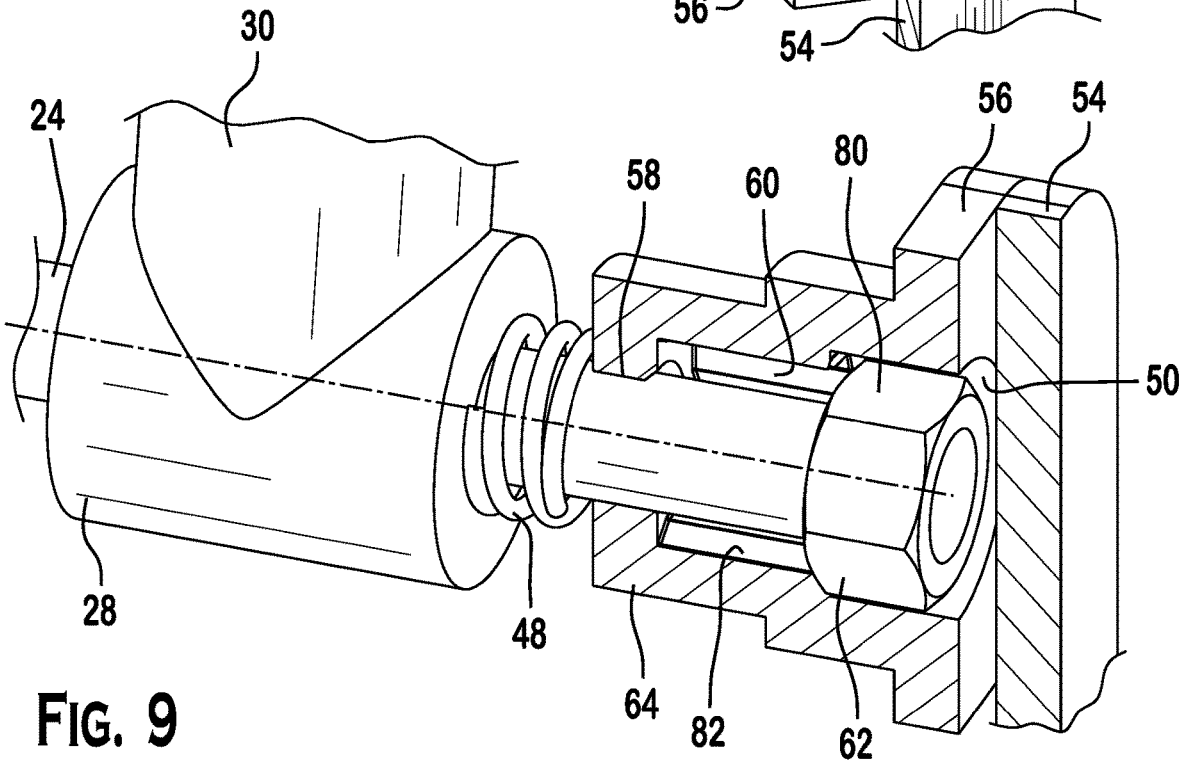
FIG. 9 is a partial, cut-away front perspective view of a second hinge housing 52 in the preferred embodiment. This figure illustrates the biasing member 44 surrounding the rod 24 and located between the chair back connector 28 of the chair back frame 26 and the second tube portion 64 of the second housing structure 56. The biasing member 44 is shown in the second, compressed position 48. When the biasing member 44 is in the second, compressed position 48, the second, keyed component 62 comprising a nut 80 is disengaged with the second, keyed receptacle 60 comprising a socket 82. In this configuration the second, keyed component 62 is fully extended into the rotation chamber 50. In the rotation chamber 50, the second key component's 62 movement is preferably, but not necessarily, uninhibited and the rod 24 is free to rotate to one of any multiple in-use positions 92.

Referring now to FIG. 9 of the present invention, the biasing member 44 is shown in a second, compressed position 48. Due to the axial displacement of the rod 24, the second, keyed component 62 comprising a nut 80 may now be located within the rotation chamber 50. Since the rotation chamber 50 may have a diameter greater than the second, keyed component 62, the second, keyed component 62 may not be in a locked position of engagement with the second, keyed receptacle 60 comprising a socket 82, and the rod 24 may be able to freely rotate. The second, keyed component 62, importantly, may not fully reach the closest axial end 66 in order to prevent unnecessary wear and tear due to friction between components.

Figure 10:
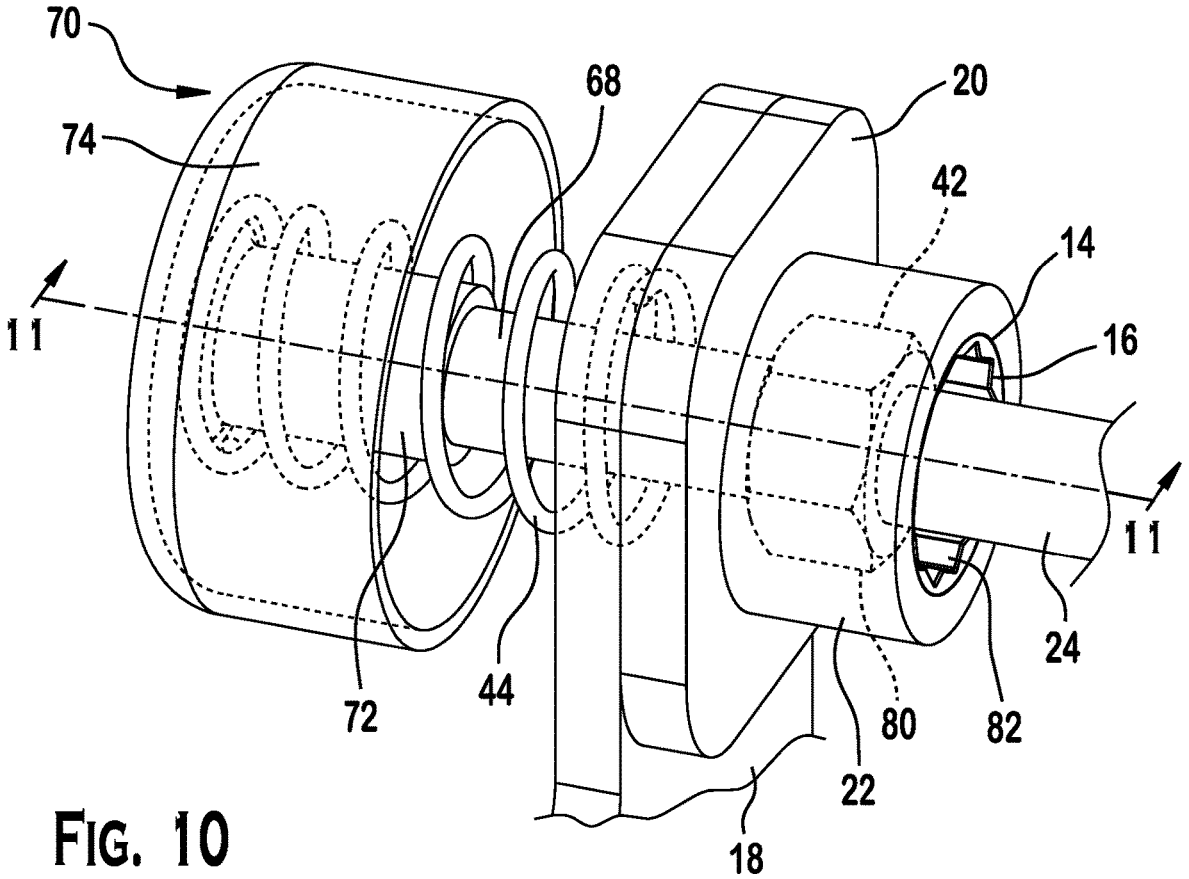
FIG. 10 is a partial, cut-away close-up front perspective view of a first hinge housing 12 in an alternative preferred embodiment. Here, the biasing member 44 is located between the user portion 74 of the knob 70 and the outer side of the first housing frame 18. The biasing member 44 partially circumferentially surrounds both the rod 24 and the rod attachment portion 72 of the knob 70. One end of the biasing member 44 abuttingly contacts the inside of the knob 70 and the other end of the biasing member 44 abuttingly contacts the outer side of the first housing frame 18. It can also be seen that the first, keyed component 42 that is attached to the rod 24 is substantially withdrawn into and engaged with the first, keyed receptacle 16 thereby preventing rotation of the rod 24.
Figure 11:
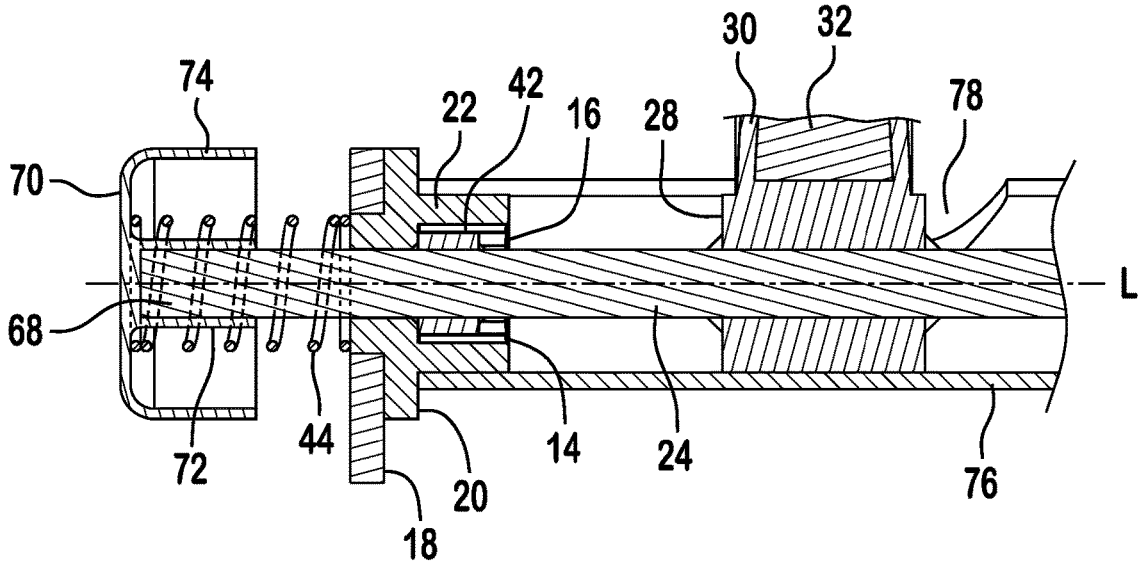
FIG. 11 is a front cross-sectional view of a first hinge housing 12 and alternative preferred embodiment. Here, the biasing member 44 is located between the user portion 74 of the knob 70 and the outer side of the first housing frame 18. The biasing member 44 partially circumferentially surrounds both the rod 24 and the rod attachment portion 72 of the knob 70. One end of the biasing member 44 abuttingly contacts the inside of the knob 70 and the other end of the biasing member 44 abuttingly contacts the outer side of the first housing frame 18. It can also be seen that the first, keyed component 42 that is attached to the rod 24 is substantially withdrawn into and engaged with the first, keyed receptacle 16 thereby preventing rotation of the rod 24.
Figure 12:
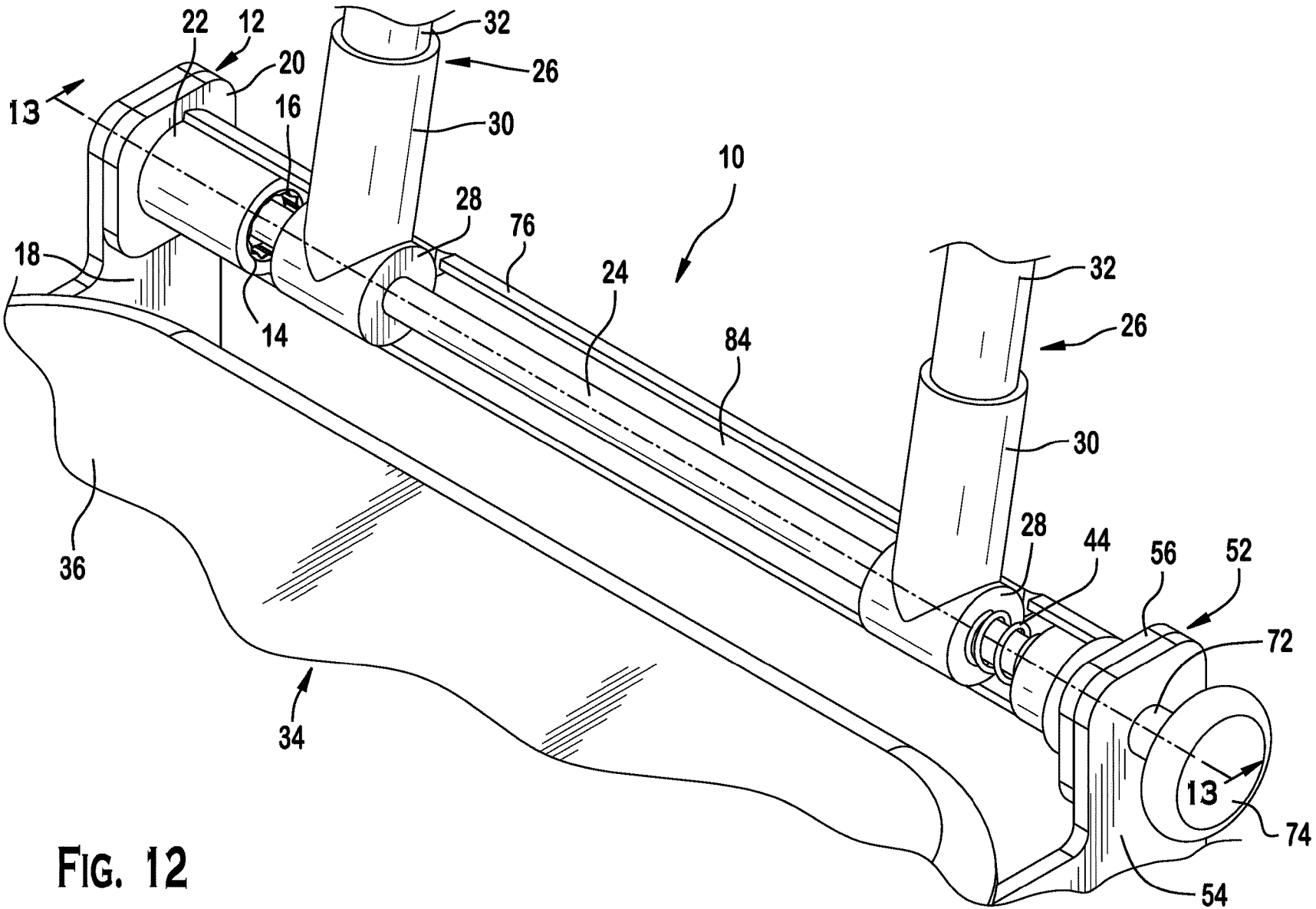
FIG. 12 is a partial, cut-away front perspective view of a hinge system 10 in an alternative preferred embodiment shown in use with the chair 110. Here, the knob 70 is located at a distal end 68 of the rod 24 that protrudes from the second hinge housing 52. By locating the knob 70 adjacent to the second hinge housing 52, the hinge system 10 is operated not by a user applying a force inward toward the center of the rod along the longitudinal axis L, but by a user pulling the knob 70 outwardly and away from the center of the rod 24 along the longitudinal axis L. However, this figure shows the biasing member 44 in the first, biased position 46, so a user has not yet operated the hinge system 10.
Figure 13:
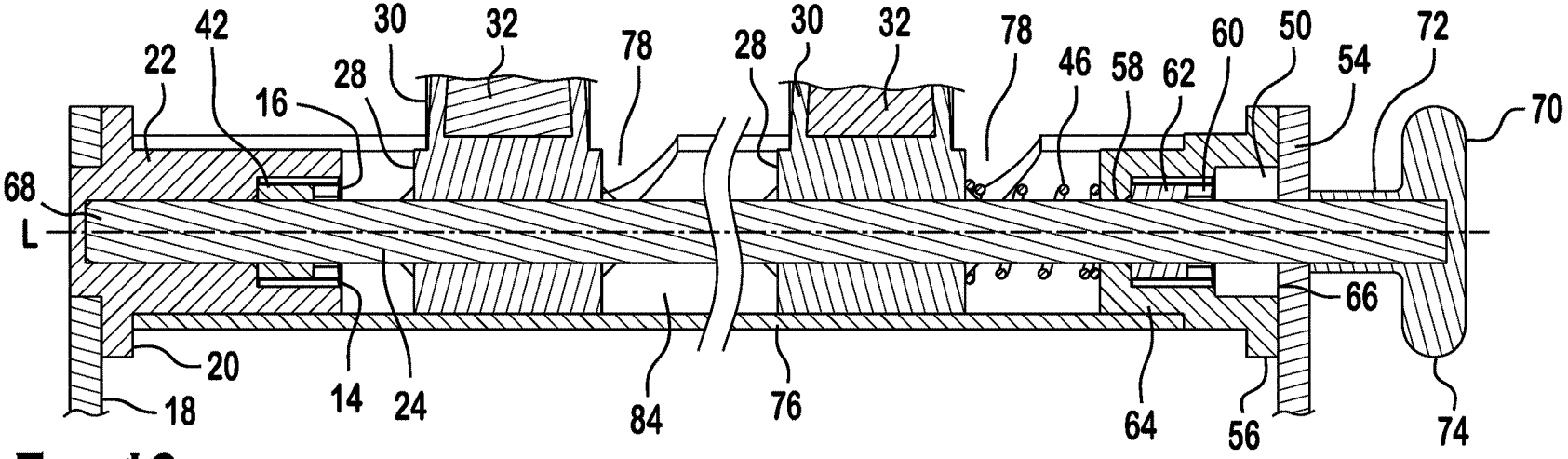
FIG. 13 is a front cross-sectional view of a hinge system 10 in an alternative preferred embodiment shown in use with the chair 110. Here, the knob 70 is located at a distal end 68 of the rod 24 that protrudes from the second hinge housing 52. By locating the knob 70 adjacent to the second hinge housing 52, the hinge system 10 is operated not by a user applying a force inward toward the center of the rod along the longitudinal axis L, but by a user pulling the knob 70 outwardly and away from the center of the rod 24 along the longitudinal axis L. However, this figure shows the biasing member 44 in the first, biased position 46, so a user has not yet operated the hinge system 10.
Figure 14:
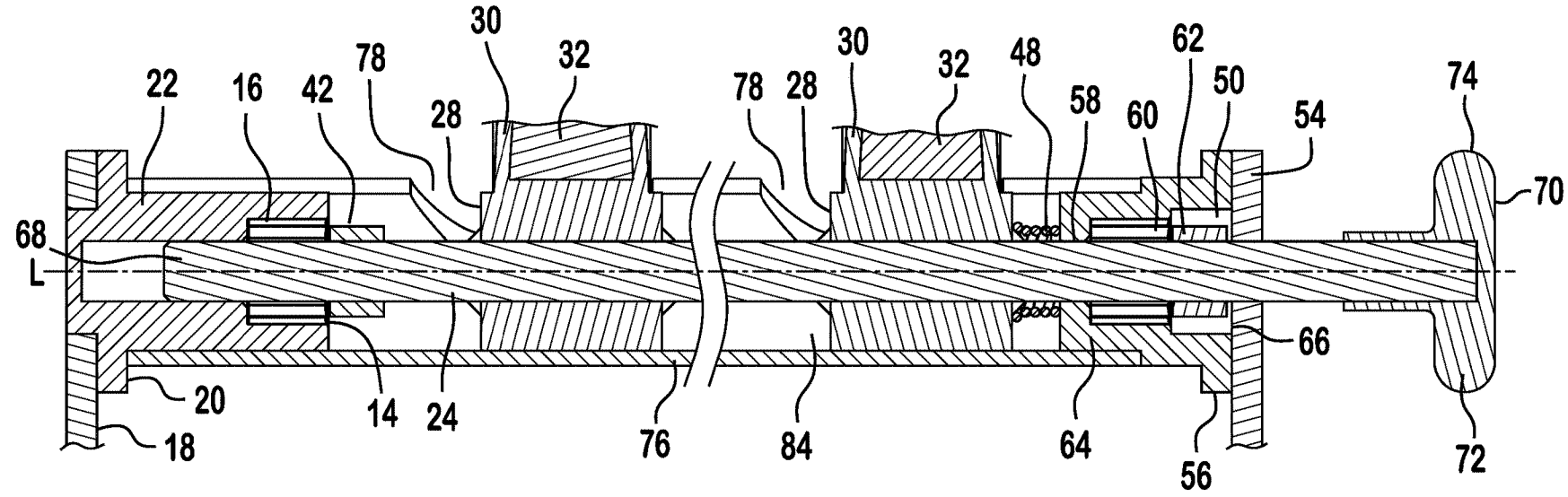
FIG. 14 is a front cross-sectional view of the hinge system 10 in an alternative preferred embodiment shown in use with the chair 110 In this embodiment, the force applied to the knob 70 by a user in order to operate the hinge system 10 is applied in a direction parallel to the longitudinal axis L, but in a direction outward and away from the center of the rod 24. Effectively, the user is pulling the knob 70 outward in order to operate the hinge system 10. This figure shows the biasing member 44 in the second, compressed position 48, so a user is in the process of operating the hinge system 10.
Figure 15:
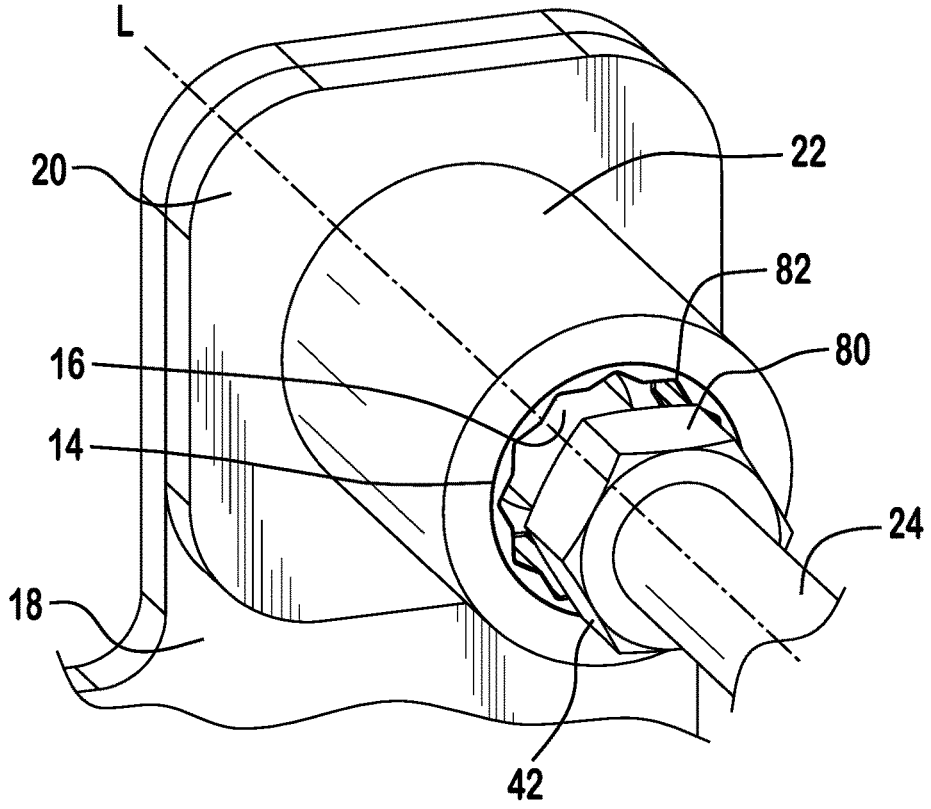
FIG. 15 is a partial perspective view of a first hinge housing 12 in the alternative preferred embodiment. Here, it can be seen that the first, keyed component 42 comprising a nut 80 is disengaged with the first, keyed receptacle 16 comprising a socket 82. The knob 70 can be seen opposite the nut 80 and the socket 82 across the first hinge housing 12. The nut 80 may be rotated along with the rod 24 by a user twisting the knob 70 and realigning the sides 96 of the nut 80 with the inner walls 98 of the socket 82.
Figure 16:
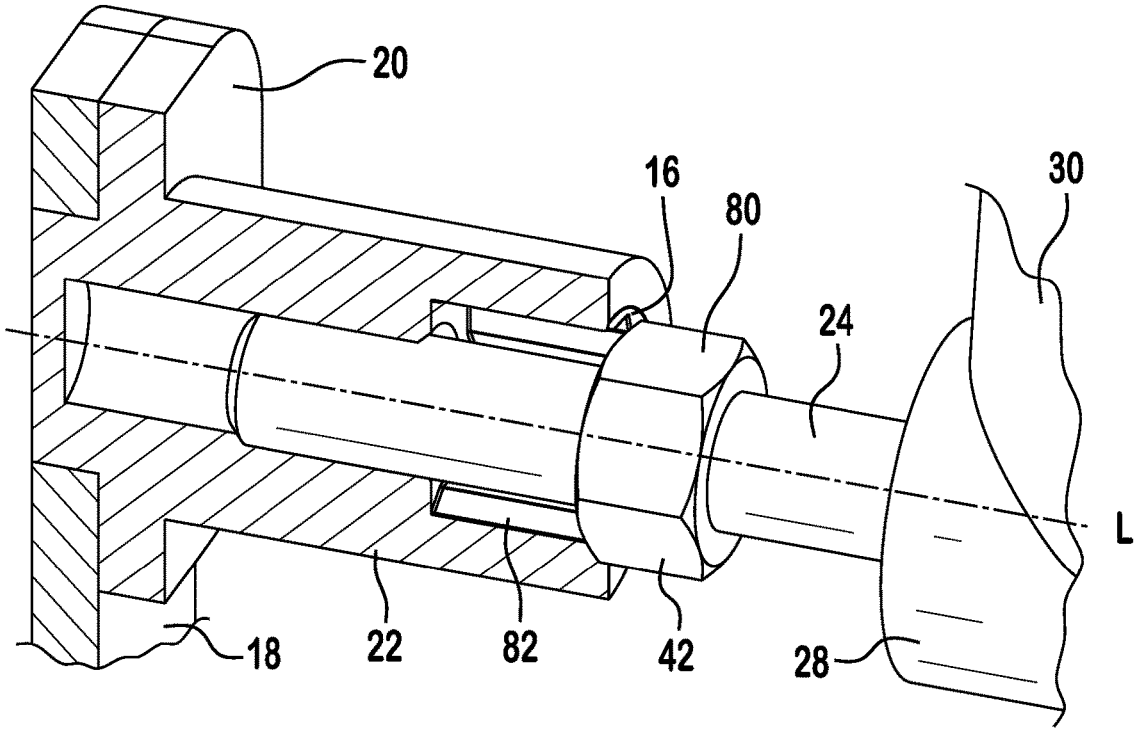
FIG. 16 is a partial, cut-away front perspective view of the hinge system 10 in an alternative preferred embodiment. The hinge system 10 comprising a first hinge housing 12 further defines a rod space 25. This figure depicts the hinge system 10 when it is being operated by a user because the rod 24 has been withdrawn from the rod space 25. The rod 24 being withdrawn from the rod space 25 corresponds to the biasing member 44 (not shown) being in the second, compressed position 48 corresponding to a user pulling the knob 70 in the alternative preferred embodiment. The rod space 25 corresponds to a location that a distal end 68 of the rod 24 would be when the biasing member 44 (not shown) is in the first, biased position 46.
Figure 17:
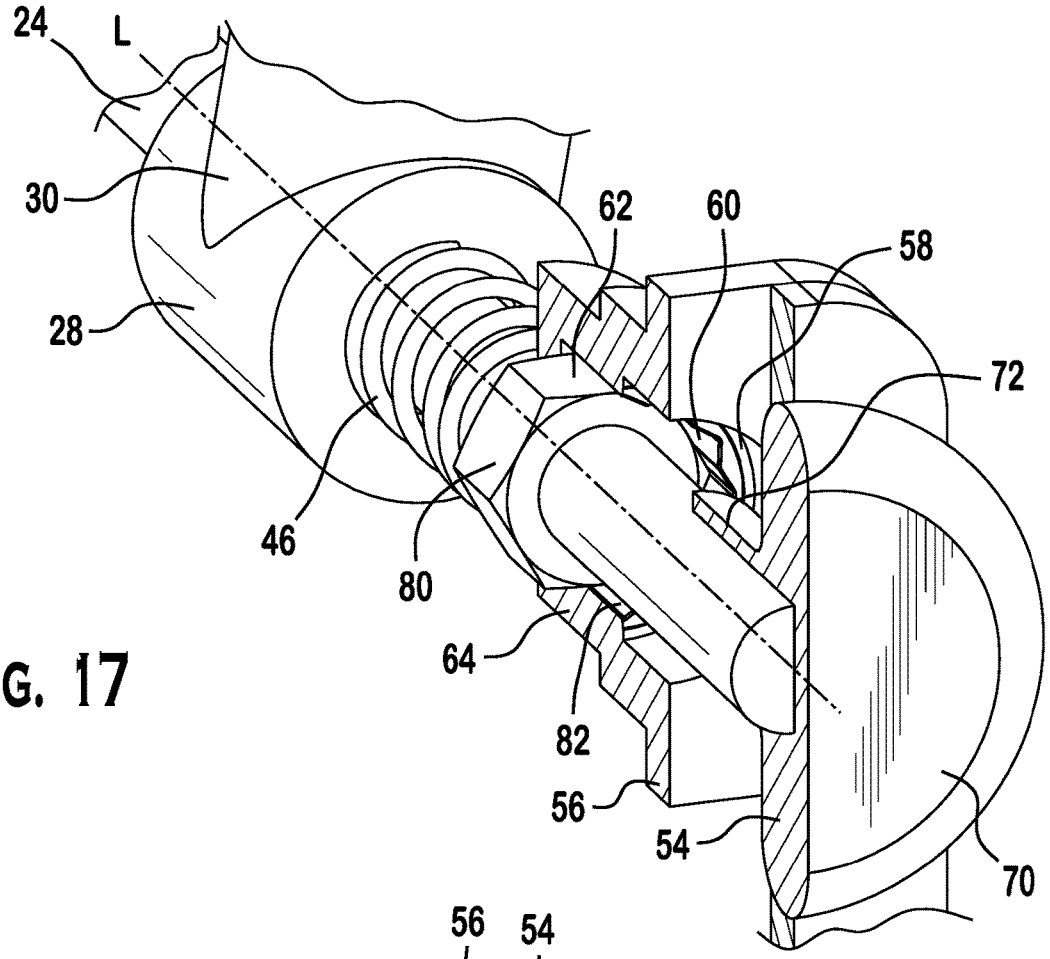
FIG. 17 is a partial, cut-away side perspective view of a second hinge housing 52 in the alternative preferred embodiment. This figure illustrates the biasing member 44 surrounding the rod 24 and located between the chair back connector 28 of the chair back frame 26 and the second tube portion 64 of the second housing structure 56. The biasing member 44 is shown in the first, biased position 46. When the biasing member 44 is in the first, biased position 46, the second, keyed component 62 comprising a nut 80 is substantially withdrawn into engagement with the second, keyed receptacle 60 comprising a socket 82. In this configuration, the second, keyed component 62 does not extend into the rotation chamber 50 because a user has not engaged the hinge system 10 by pulling the knob 70 outwardly.
Figure 18:
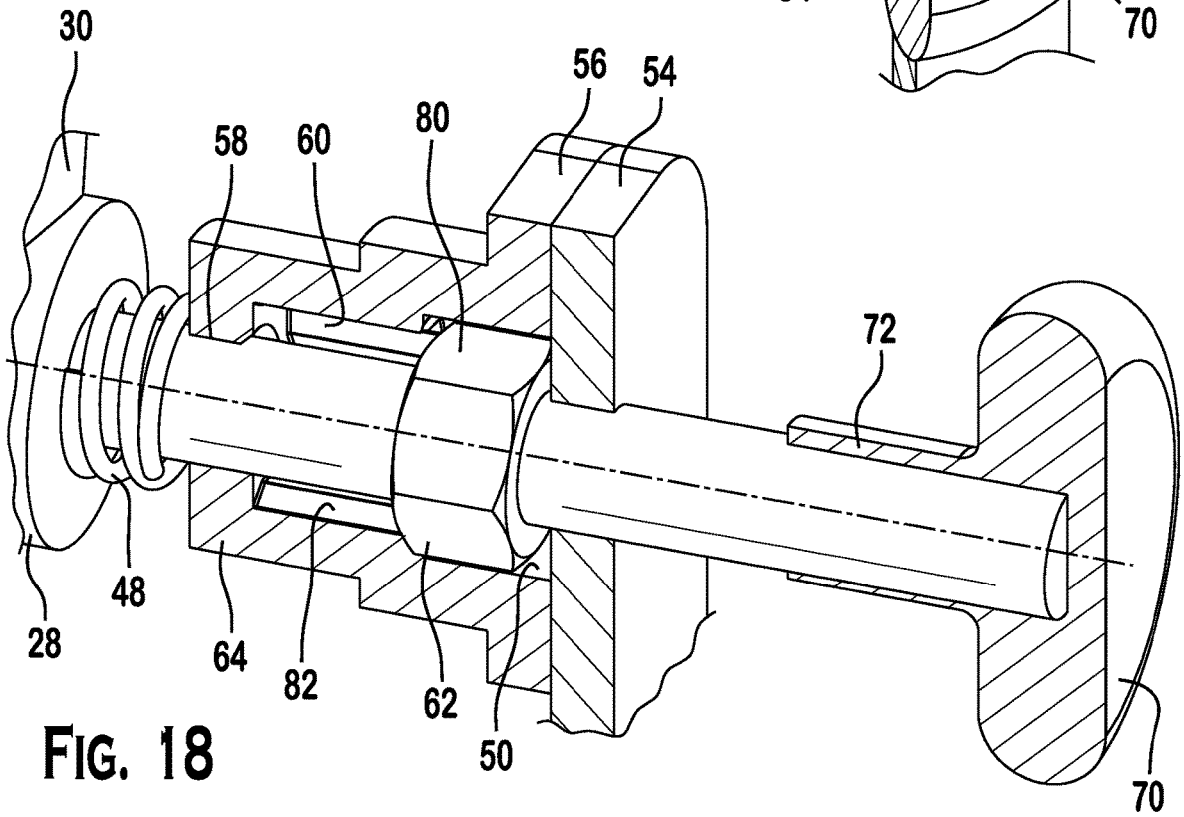
FIG. 18 is a partial, cut-away front perspective view of a second hinge housing 52 in the alternative preferred embodiment. This figure illustrates the biasing member 44 surrounding the rod 24 and located between the chair back connector 28 of the chair back frame 26 and the second tube portion 64 of the second housing structure 56. The biasing member 44 is shown in the second, compressed position 48. The biasing member 44 is in the second, compressed position when a user pulls the knob 70 outwardly and engages the hinge system 10. When the biasing member 44 is in the second, compressed position 48, the second, keyed component 62 comprising a nut 80 is moved axially out of engagement with the second, keyed receptacle 60 and into the rotation chamber 50.
Figure 19:
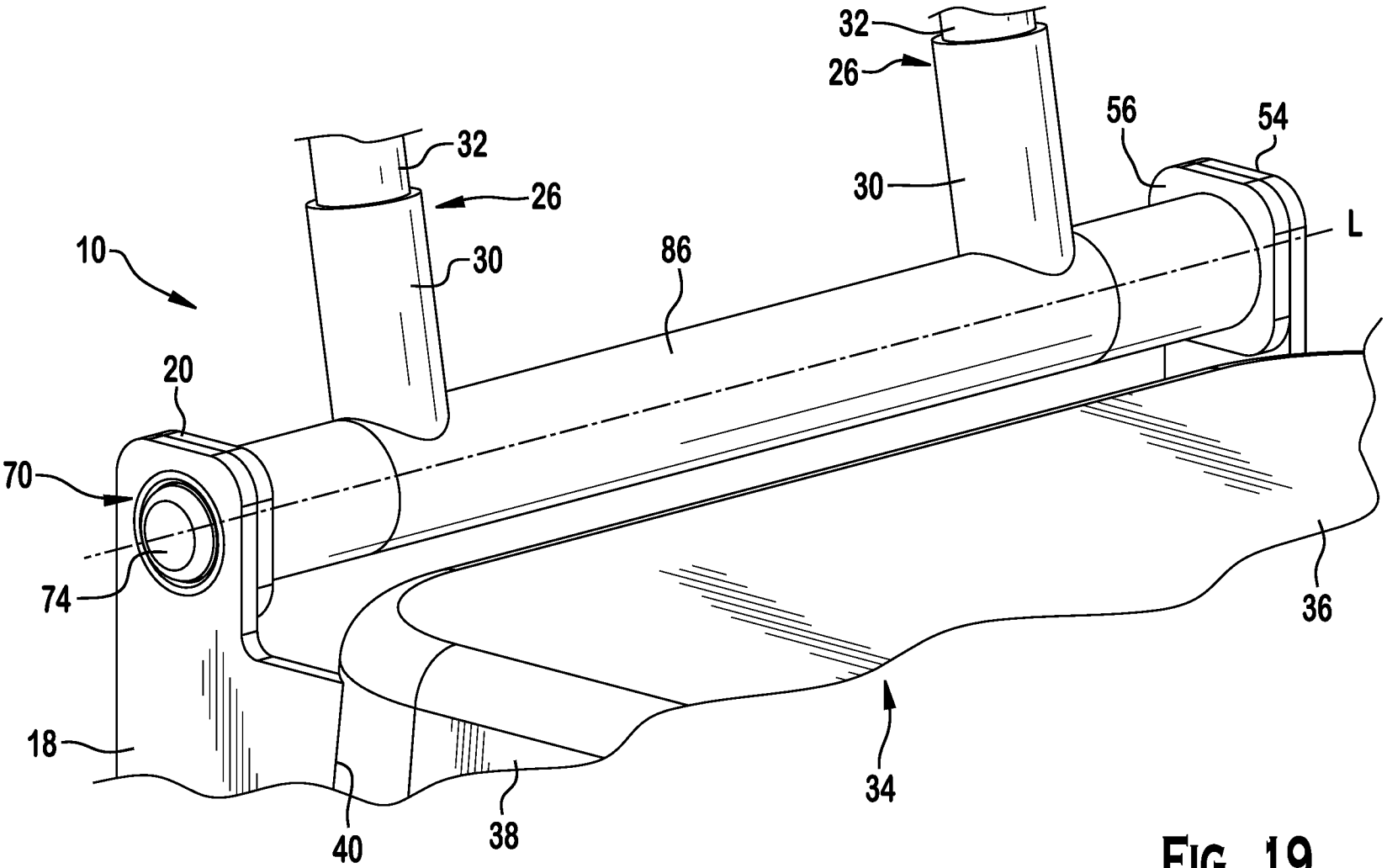
FIG. 19 is a partial front perspective view of a hinge system 10 in an alternative preferred embodiment shown in use with a chair 110. Here, a first hinge housing 12 and a second hinge housing 52 are shown connected to a chair seat frame 34. The first hinge housing 12 and the second hinge housing 52 comprise a first housing frame 18 and a second housing frame 54, respectively. The first housing frame 18 and the second housing frame 54 each comprise flattened, L-shaped plates that connect at seat housing connections 42 to the chair seat frame 34. The first hinge housing 12 and the second hinge housing 52 further comprise a first housing structure 20 and a second housing structure 56, respectively. A knob 70 is connected at one side of the first hinge housing 12. The knob 70 is recessed into the first hinge housing 12. The first hinge housing 12 and the second hinge housing 52 are axially spaced from one another, and an elongated housing 76 stretches therebetween. The elongated housing 76 is integrally formed with the chair back frame 26. The chair back support 30 of the chair back frame 26 is directly connected to and extends radially away from the elongated housing 76.
Figure 20:
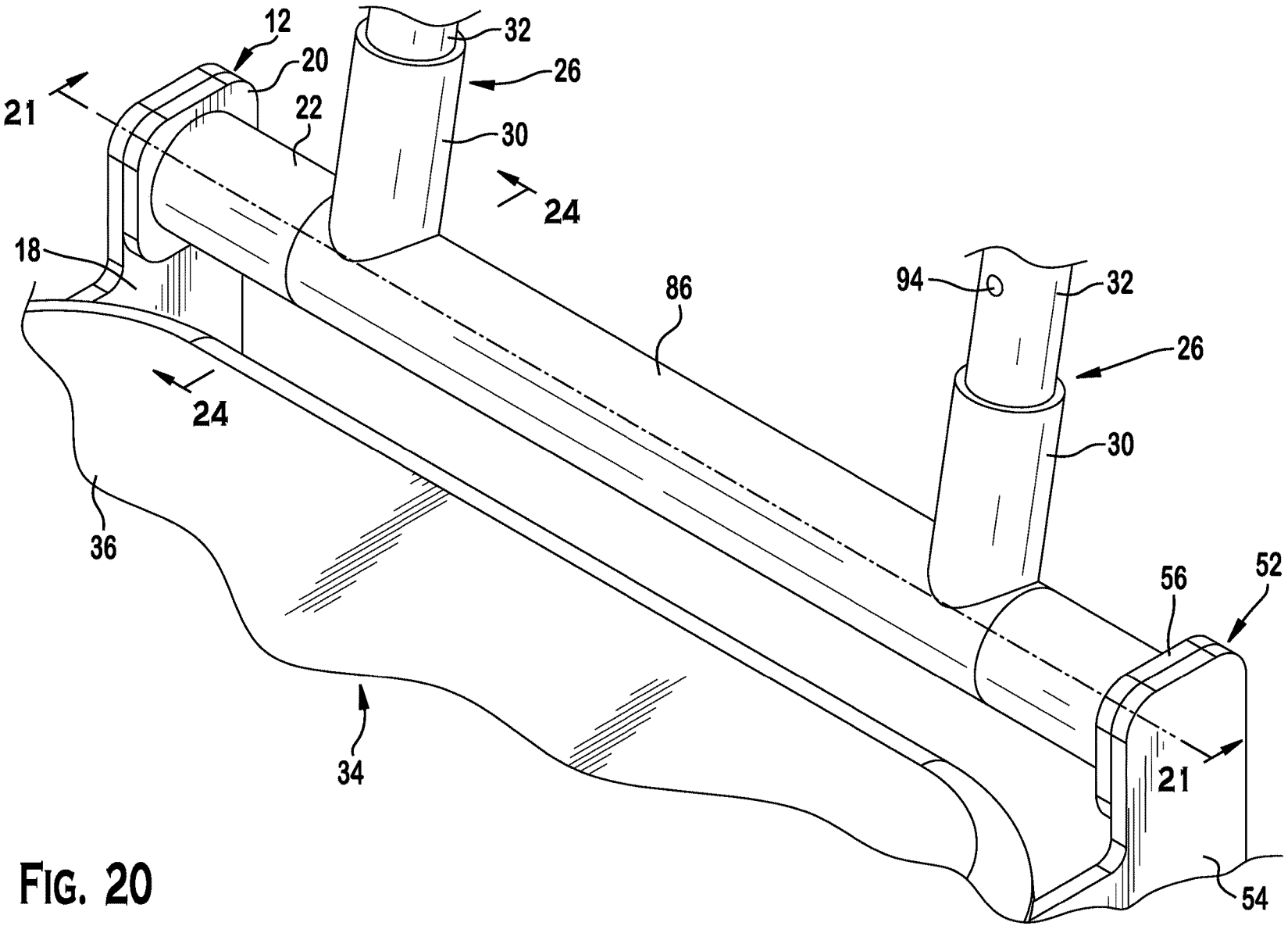
FIG. 20 is a partial front perspective view of a hinge system 10 in an alternative preferred embodiment shown in use with a chair 110. Here, a first hinge housing 12 and a second hinge housing 52 are shown connected to a chair seat frame 34. The first hinge housing 12 and the second hinge housing 52 comprise a first housing frame 18 and a second housing frame 54, respectively. The first housing frame 18 and the second housing frame 54 each comprise flattened, L-shaped plates that connect at seat housing connections 42 to the chair seat frame 34. The first hinge housing 12 and the second hinge housing 52 further comprise a first housing structure 20 and a second housing structure 56, respectively. The first hinge housing 12 and the second hinge housing 52 are axially spaced from one another, and an elongated housing 76 stretches therebetween. The elongated housing 76 is integrally formed with the chair back frame 26. The chair back support 30 of the chair back frame 26 is directly connected to and extends radially away from the elongated housing 76. A chair back post 32 is preferably partially enclosed at one end by the chair back support 30. The chair back post 32 may include a detent pin 94 that allows for sliding and locking of the chair back post 32 within the chair back support 30.

Referring generally to FIGS. 10 and 11 of an alternative preferred embodiment of the present invention, the biasing member 44 may be located axially between the outside of the first, hinge housing 12 and the inside of the knob 70. The biasing member 44 is shown in the first, biased position 46. The biasing member 44 may radially surround the rod 24 and the rod attachment portion 72 of the knob 70. The biasing member 44 will not extend axially past the distal end 68 of the rod 24. Locating the biasing member 44 in this alternative preferred location may be advantageous in order to more easily service worn components without having to remove components such as the elongated housing 76.

Referring generally to FIGS. 12-18 of an alternative preferred embodiments of the present invention, the knob 70 may be located axially adjacent the second hinge housing 52. Here, the biasing member 44 may be in substantially the same place as in the preferred embodiment of the present invention and provide a biasing force in the same direction along the longitudinal axis L. Now for a user to convert the biasing member 44 from the first, biased position 46 to the second, compressed position 48, the user may pull the knob axially 70 outward and away from the second hinge housing 52 and the center of the hinge system 10. The first hinge housing 12 may now include a rod space 25 contained therein (shown FIGS. 14 and 16) to accommodate the distal rod end 68 when the first, keyed component 42 and the first, keyed receptacle 16 are biased into engagement. The user may still freely rotate the rod 24 to any one of multiple in-use positions when the biasing member 44 is in the second, compressed position 48. Requiring the knob 70 to be pulled outward instead of pushed inward may be advantageous and desirous to eliminate the possibility of accidental engagement due to inadvertent bumping by an external source.

Referring generally to FIGS. 19-22 of an alternative preferred embodiment of the present invention, the chair back support 30 of the chair back frame 26 may be integrally formed with a connection housing 86. This may be advantageous for more easily manufacturing the necessary components and reducing the total number of components required by the present invention. This embodiment eliminates the structural need for an elongated housing 76 with at least one slot 78 and the chair back connectors 28. A detent pin 94 (shown FIG. 20) may be included in the chair back post 32 to allow the chair back frame 26 to be detachably affixed to the chair back support 30 and the rest of the hinge system 10. Those of ordinary skill in the art will appreciate from this disclosure that the chair back frame may be permanently connected to the hinge assembly without departing from the scope of the present invention. Similarly, any detachable connection mechanism between the chair back frame and the hinge can be used without departing from the scope of the present invention.

Figure 21:
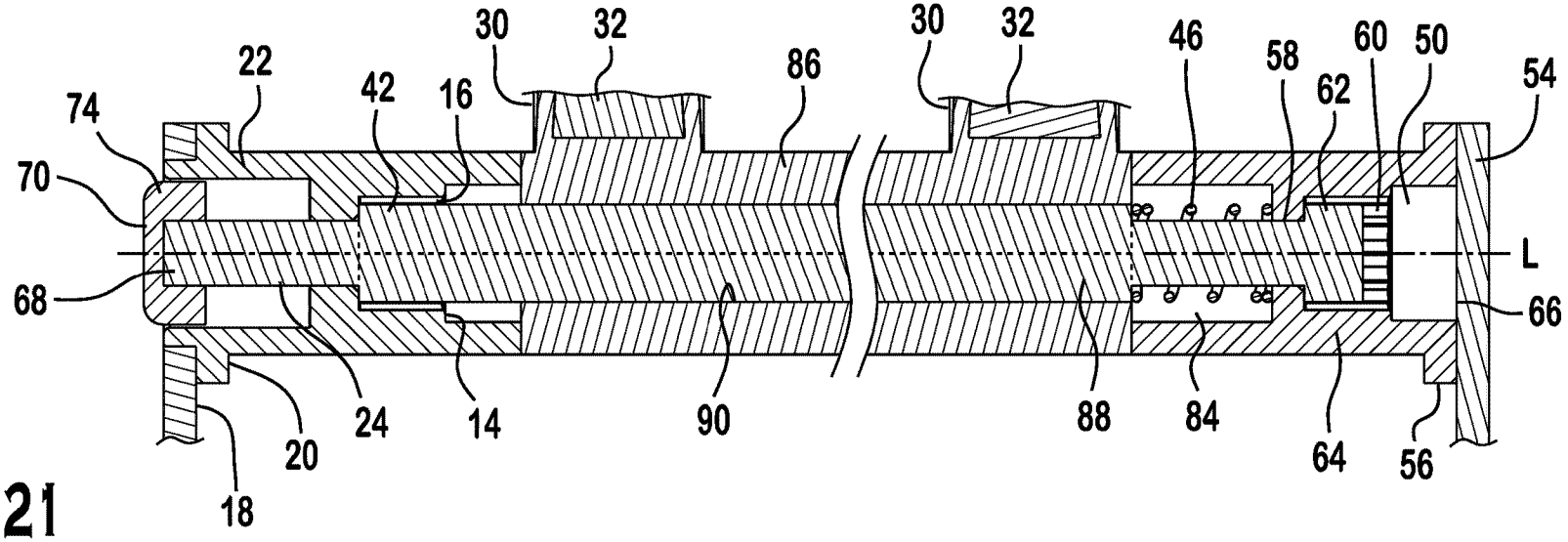
FIG. 21 is a front cross-sectional view of a hinge system 10 in an alternative preferred embodiment. Here, a keyed rod 88 can be seen spanning the axial distance between the first hinge housing 12 and the second hinge housing 52. The rod includes a distal end 68. The keyed rod 88 corresponds to the keyed components 42, 62 of the preferred embodiment. The distal end 68 is connected to a knob 70. The knob 70 comprises a rod attachment portion 72 that abutting the contacts the distal end 68 of the rod 24. The knob 70 is recessed into the first housing 12. The knob 70 also comprises a user portion 74 that allows a user of the hinge system 10 to push the knob 70 and engage the hinge system 10. The keyed rod 88 can be seen engaged with the first, keyed receptacle 16. The second tube portion 64 defines a second hole 58. The second hole 58 forms a second, keyed receptacle 60. The keyed rod 88 can be seen engaged with the second, keyed receptacle 60. The biasing member 44 can be seen in a first, biased position 46. The biasing member 44 in the first, biased position 46 creates the automatic engagement of the keyed rod 88 with the first, keyed receptacle 16 and the second, keyed receptacle 60. An elongated housing 76 can also be seen radially surrounding the keyed rod 88. The elongated housing 76 has a connection housing inner surface 90 that has corresponding surfaces to abuttingly contact the keyed rod 88.
Figure 22:
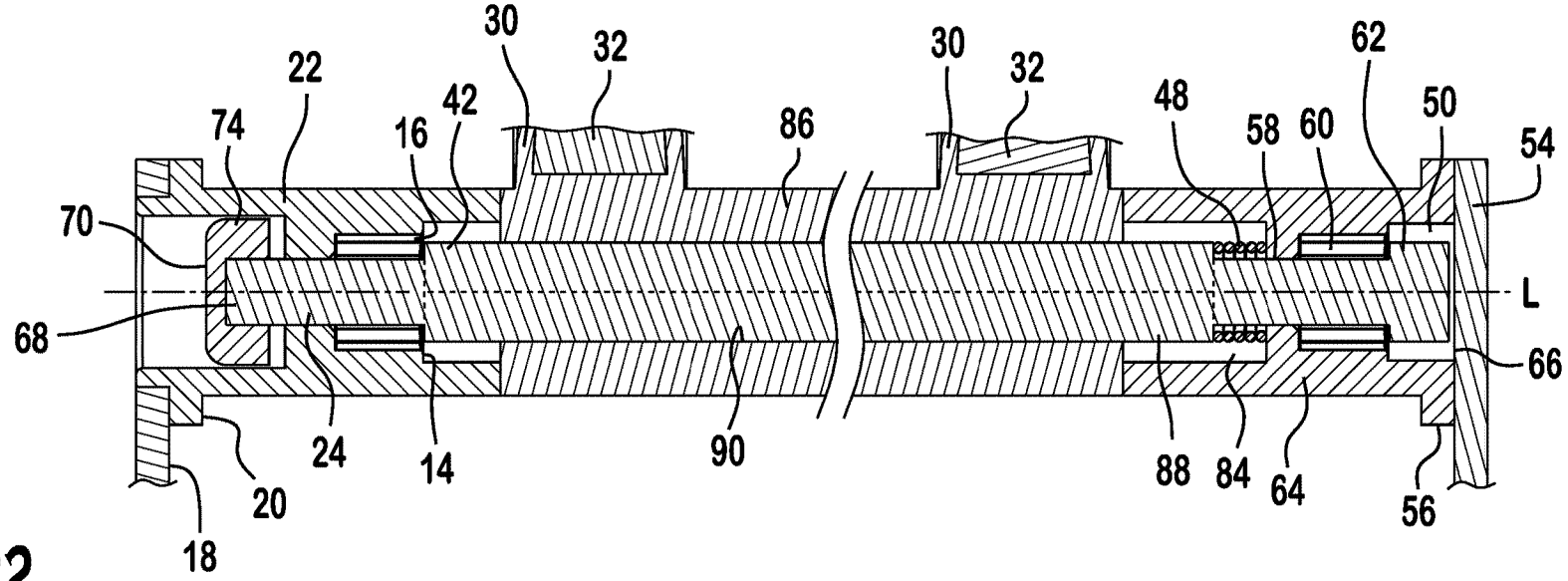
FIG. 22 is a front cross-sectional view of a hinge system 10 in an alternative preferred embodiment. Here, a keyed rod 88 can be seen spanning the axial distance between the first hinge housing 12 and the second hinge housing 52. The rod includes a distal end 68. The keyed rod 88 corresponds to the keyed components 42, 62 of the preferred embodiment. The distal end 68 is connected to a knob 70. The knob 70 comprises a rod attachment portion 72 that abutting the contacts the distal end 68 of the rod 24. The knob 70 is recessed into the first housing 12. The knob 70 also comprises a user portion 74 that allows a user of the hinge system 10 to push the knob 70 and engage the hinge system 10. The keyed rod 88 can be seen engaged with the first, keyed receptacle 16. The second tube portion 64 defines a second hole 58. The second hole 58 forms a second, keyed receptacle 60. The keyed rod 88 can be seen engaged with the second, keyed receptacle 60. The biasing member 44 can be seen in a second, compressed position 48. The biasing member 44 in the second, compressed position 48 allows the keyed rod 88 to be disengaged with the first, keyed receptacle 16 and the second, keyed receptacle 60. An elongated housing 76 can also be seen radially surrounding the keyed rod 88. The elongated housing 76 has a connection housing inner surface 90 that has corresponding surfaces to abuttingly contact the keyed rod 88. The disengagement of the keyed rod 88 from the first, keyed receptacle 16 and the second, keyed receptacle 60 allows the rod to rotate about the longitudinal axis L. The rotation of the keyed rod 88 also rotates the elongated housing 76 due to the abutting contact of the keyed rod 88 with the connection housing inner surface 90.
Figure 23:
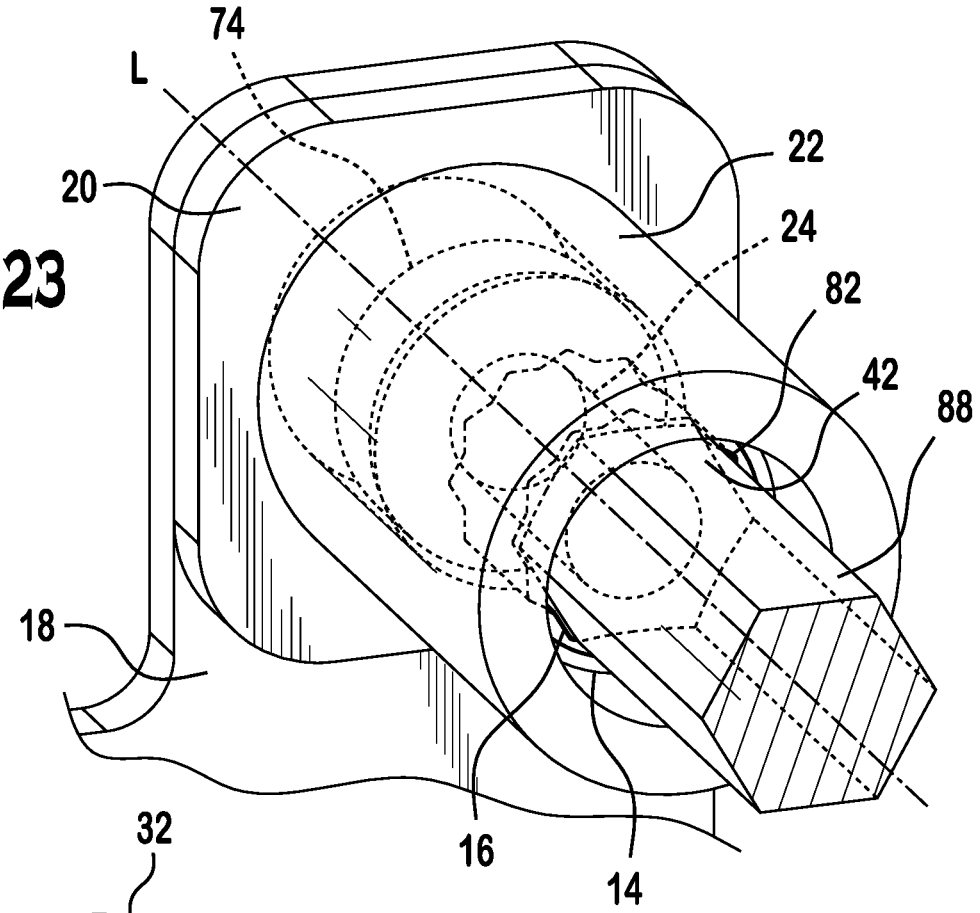
FIG. 23 is a partial perspective view of a first hinge housing 12 in the alternative preferred embodiment. Here, it can be seen that the keyed rod 88 is disengaged from the first, keyed receptacle 16. This allows the keyed rod 88 to be rotated about the longitudinal axis L.
Figure 24:
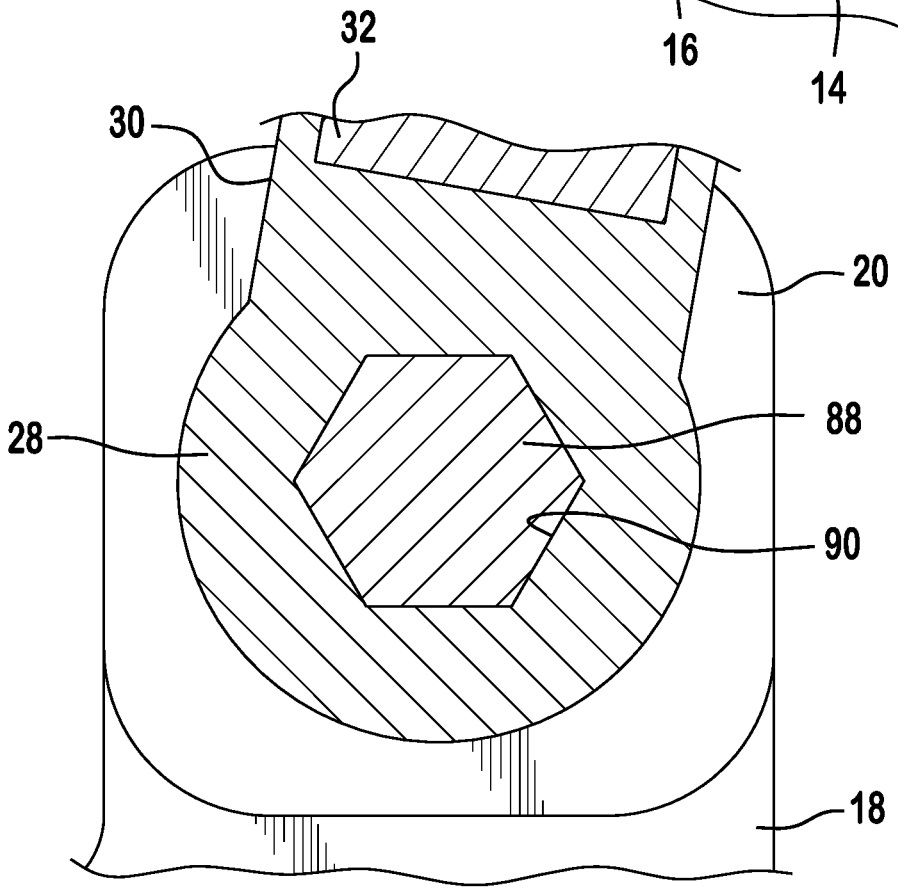
FIG. 24 is a side cross-sectional view of a hinge system 10 in the alternative preferred embodiment. Here, it can be seen that the keyed rod 88, when viewed in this side cross-sectional view, is hexagon shaped. This figure also illustrates the keyed rod 88 and abutting contact with the connection housing inner surface 90. This allows the chair back connector 28 to rotate as the keyed rod 88 rotates.
Figure 25:
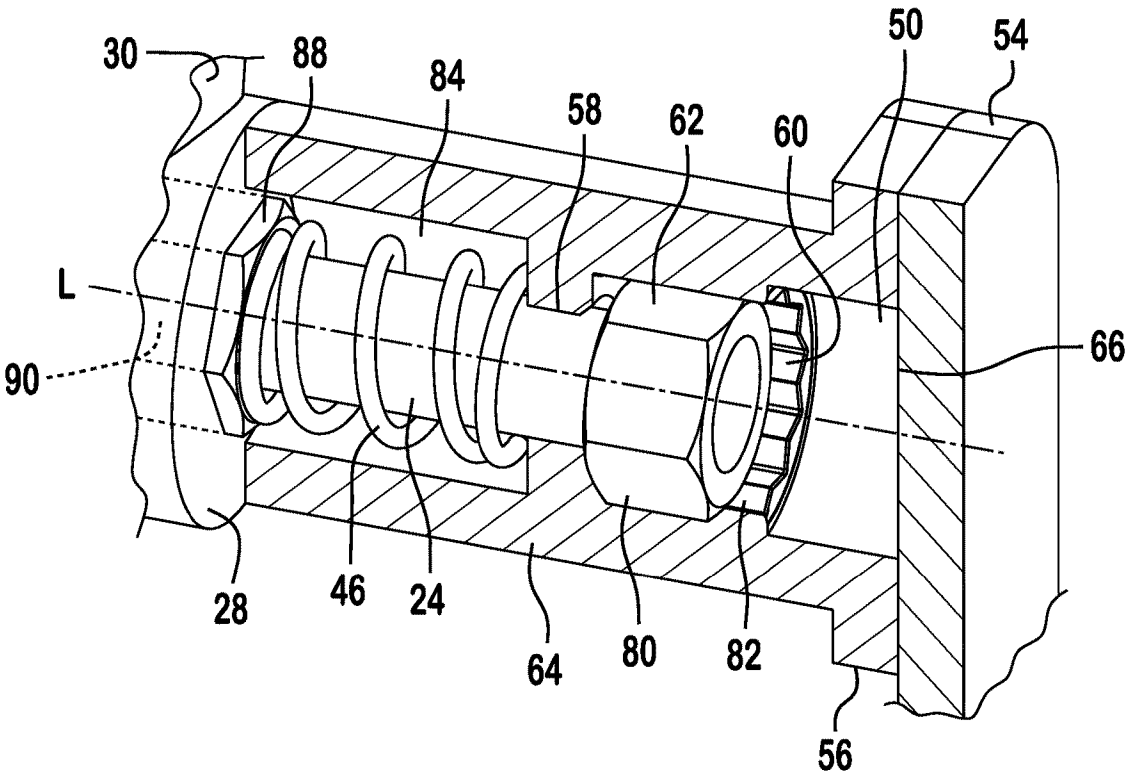
FIG. 25 is a partial, cut-away front perspective view of a second hinge housing 52 in the alternative preferred embodiment. The biasing member 44 is shown in the first, biased position 46. When the biasing member 44 is in the first, biased position 46, the second, keyed component 62 is automatically biased into engagement with the second, keyed receptacle 60. The keyed rod 88 is in abutting contact with the connection housing inner surface 90.
Figure 26:
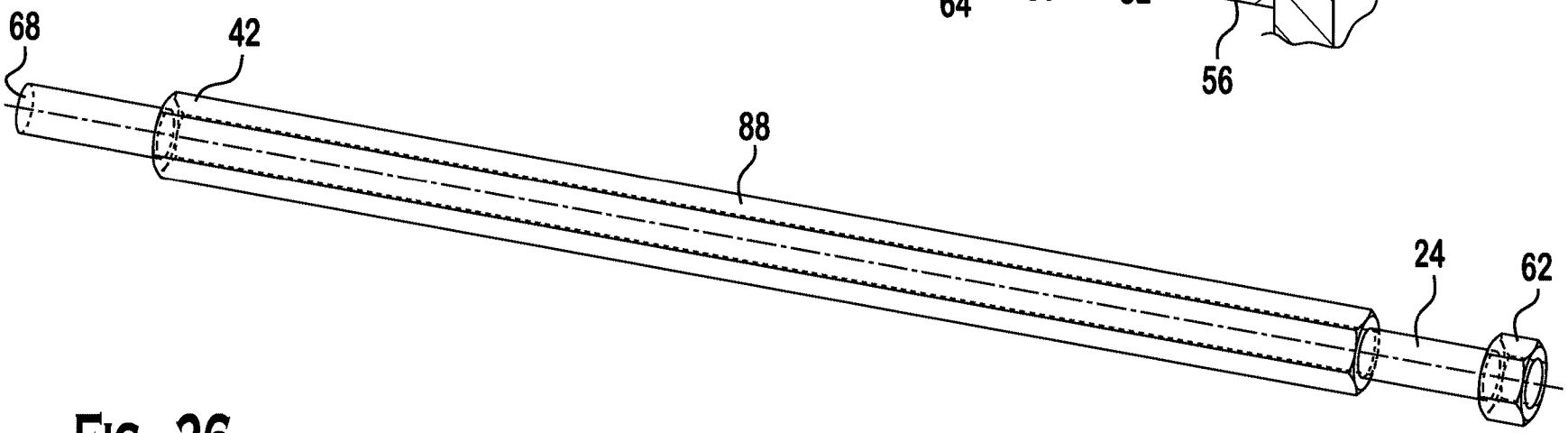
FIG. 26 is a front perspective view of a rod 24 in the alternative preferred embodiment. Here can be seen that the rod 24 forms the keyed rod 88. The rod 24 has second, keyed component 62 disposed thereon. The keyed rod 88 integrally forms the first, keyed component 42. When viewed in a cross-section, the keyed rod 88 is hexagon shaped.
Figure 27:
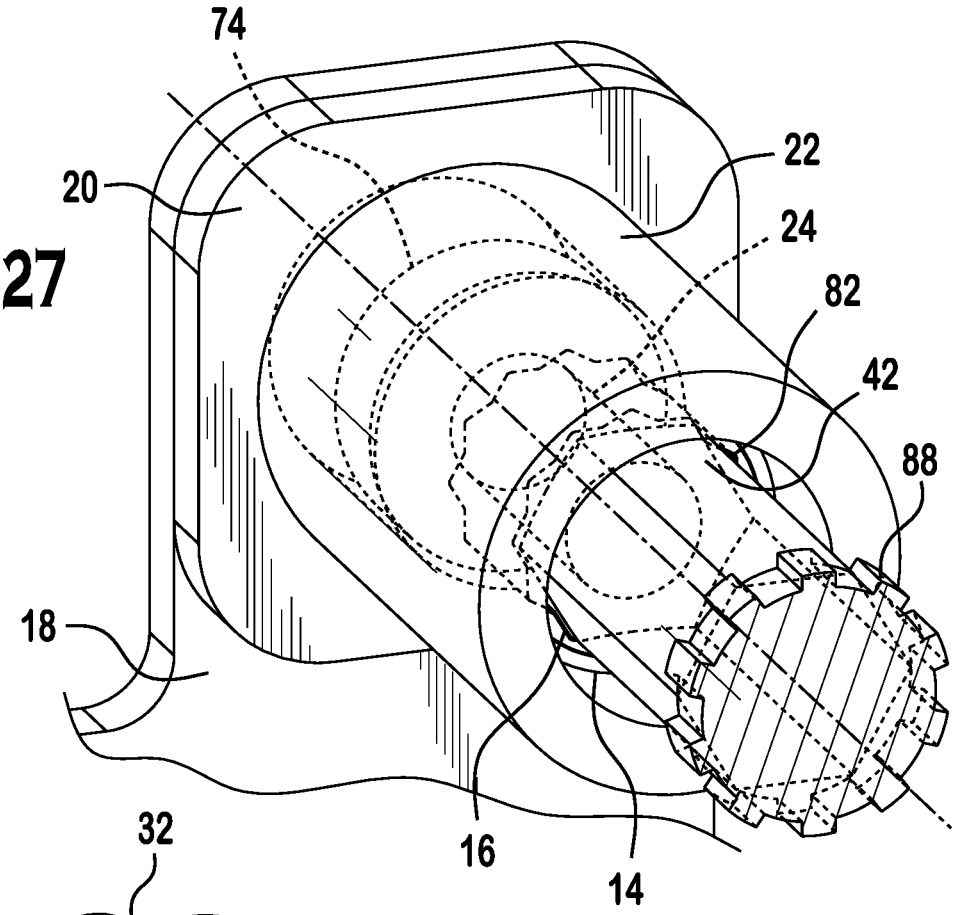
FIG. 27 is a partial perspective view of a first hinge housing 12 in the alternative preferred embodiment. Here, it can be seen that the keyed rod 88 is disengaged from the first, keyed receptacle 16. This allows the keyed rod 88 to be rotated about the longitudinal axis L.
Figure 28:
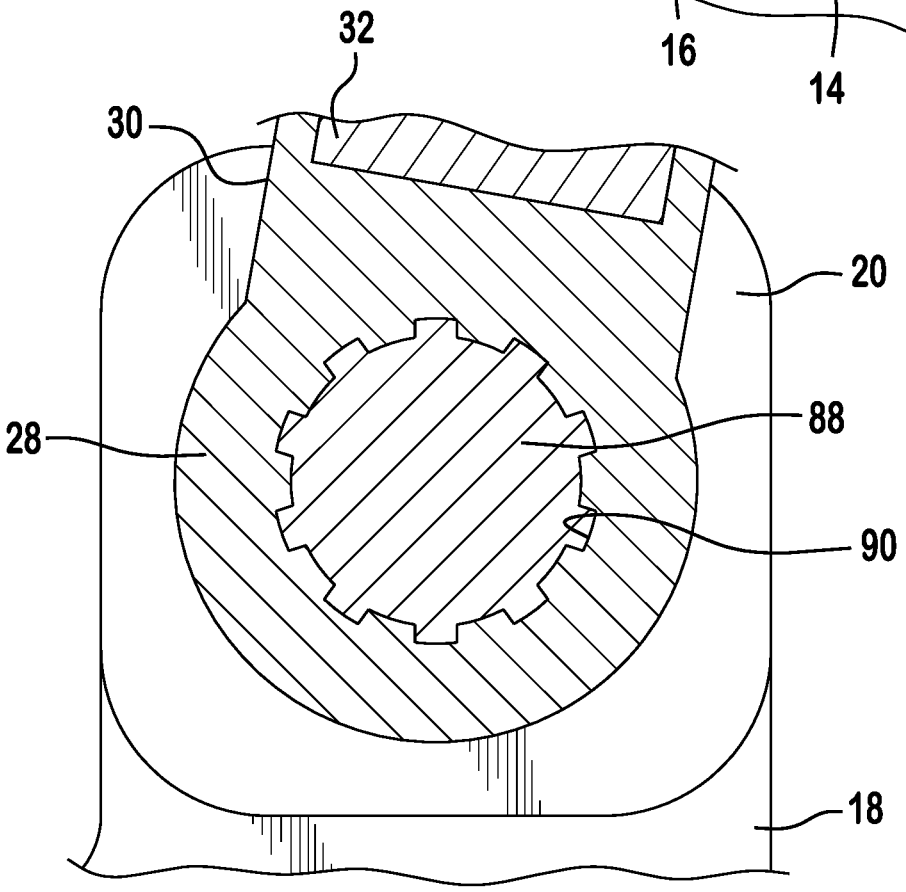
FIG. 28 is a side cross-sectional view of a hinge system 10 in the alternative preferred embodiment. Here, it can be seen that the keyed rod 88, when viewed in this side cross-sectional view, is splined or gear shaped. This figure also illustrates the keyed rod 88 and abutting contact with the connection housing inner surface 90. This allows the chair back connector 28 to rotate as the keyed rod 88 rotates.
Figure 29:
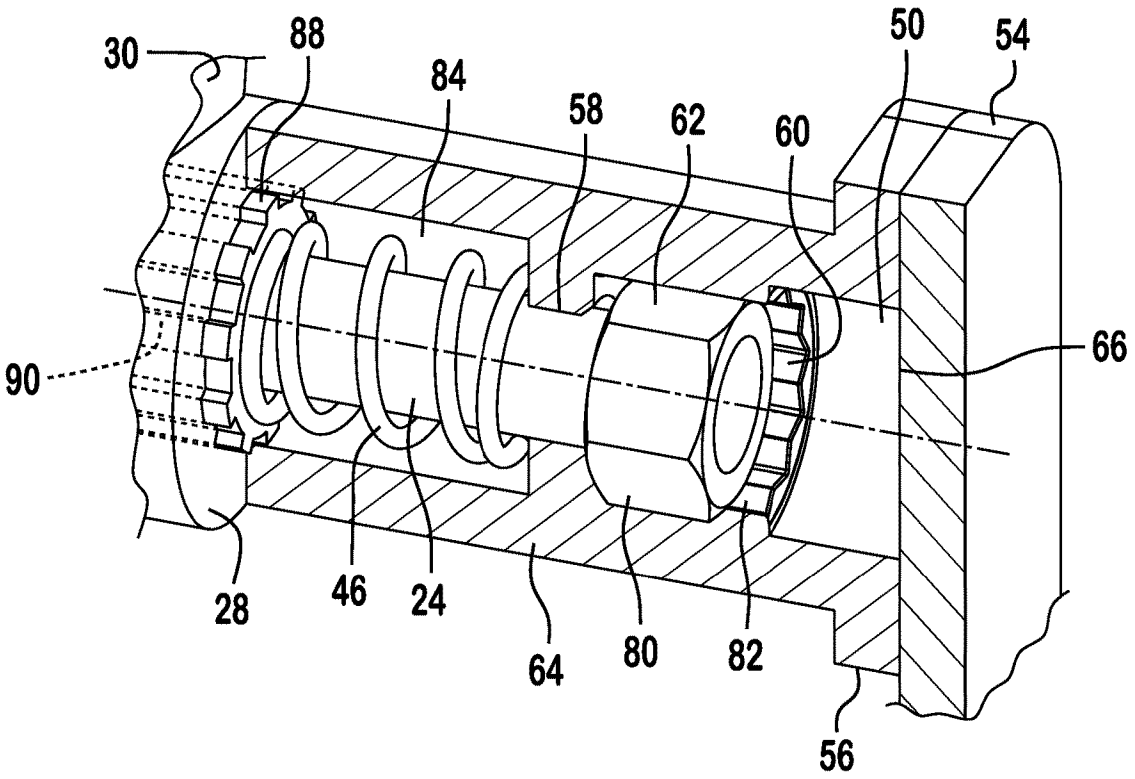
FIG. 29 is a partial, cut-away front perspective view of a second hinge housing 52 in the alternative preferred embodiment. The biasing member 44 is shown in the first, biased position 46. When the biasing member 44 is in the first, biased position 46, the second, keyed component 62 is automatically biased into engagement with the second, keyed receptacle 60. The keyed rod 88 is in abutting contact with the connection housing inner surface 90.
Figure 30:
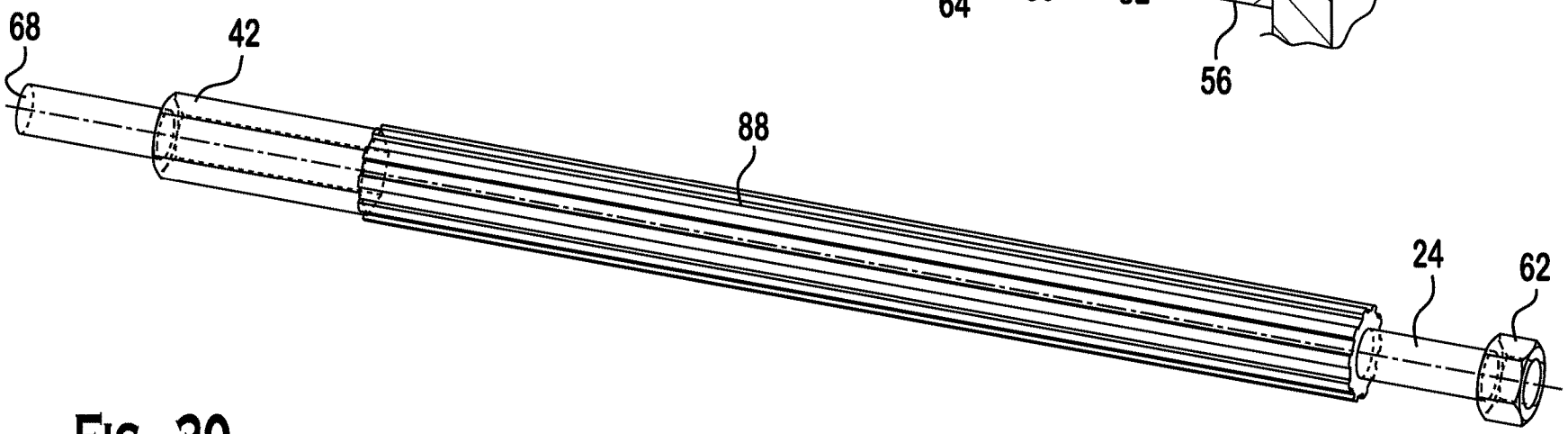
FIG. 30 is a front perspective view of a rod 24 in the alternative preferred embodiment. Here can be seen that the rod 24 forms the keyed rod 88. The rod 24 has second, keyed component 62 disposed thereon. This preferably allows the keyed rod 88 to integrally form the first, keyed component 42. When viewed in a cross-section, the keyed rod 88 is splined or gear shaped. It is preferred that the portion of the rod which has a cylindrical shape and protrudes from the left side of the first, keyed component 42 occupies the first keyed receptacle while the rod is rotating so that the chair back frame can be moved to another in-use position. The rod 24 immediately to the left of the second keyed component 62 is preferably configured of allow the rod to slide through second hole 58 when adjusting the rotational position of the keyed rod 88. The preferable, but not necessary, reduced diameter of this cylindrical section of rod also facilitates positioning a biasing member, such as a spring or the like therearound to bias the rod 88 along the longitudinal direction.

Referring specifically to FIGS. 21 and 22 of the alternative preferred embodiment of the present invention, the knob 70 may be substantially withdrawn into the first hinge housing 12. The knob 70 being substantially withdrawn into the first hinge housing 12 preferably means that no more than fifty percent (50%) of the knob 70 protrudes from the first hinge housing 12. More preferably, the knob 70 being substantially withdrawn into the first hinge housing 12 means that no more than twenty-five percent (25%) of the knob 70 protrudes from the first hinge housing 12. More preferably still, the knob 70 being substantially withdrawn into the first hinge housing 12 means that no more than ten percent (10%) of the knob 70 protrudes from the first hinge housing 12. Most preferably, the knob 70 being substantially withdrawn into the first hinge housing 12 means that none of the knob 70 protrudes from the first hinge housing 12. This may be advantageous to improve the overall aesthetic appearance of the hinge system 10 as a self-contained apparatus as well as reduce the risk of accidental engagement of the present invention by external forces. For a user to engage the hinge system, the user may depress the knob 70 into the first hinge housing 12 and then may manually rotate the chair back frame 26 to any one of multiple in-use positions 92. Those of ordinary skill in the art will appreciate from this disclosure that the potential in-use positions 92 are not limited to those shown in FIG. 31. Those of ordinary skill in the art will appreciate from this disclosure that any number of in-use positions and any regular interval, irregular interval, combination of both, or number of angular intervals between adjacent in-use positions 92 can be used without departing from the scope of the present invention.

Referring still to FIGS. 21 and 22 of an alternative preferred embodiment of the present invention, the rod 24 may comprise a keyed rod 88. The keyed rod 88 may be accustomed to fit with a connection housing inner surface 90 defined by the connection housing 86. The keyed rod 88 preferably has six sides and the connection housing inner surface 90 preferably has six corresponding inner edges. One of ordinary skill in the art would appreciate from this disclosure that the keyed rod 88 and the connection housing inner surface 90 may comprise any number of sides greater than two as desired for tensile strength and friction between components without departing from the scope of the present invention. The fit between the keyed rod 88 and the connection housing inner surface 90 may allow for axial sliding of the keyed rod 88 within the connection housing 86, but the fit impedes and disallows any relative rotation between these two components. The fit thereby may lock the keyed rod 88 and the connection housing 86 together radially, but not axially. However, those of ordinary skill in the art will appreciate from this disclosure that the keyed rod may be secured to the housing by an axial lock without departing from the scope of the present invention.

Referring generally to FIGS. 23-26 of an alternative embodiment of the present invention, the keyed rod 88 may comprise the first, keyed component 42 and the second, keyed component 62. The keyed rod 88 preferably may have six sides corresponding to the six sides of standard nut 80 and socket 82. The keyed rod 88 forming the nut 80 corresponding to the socket 82 may be advantageous to construct the rod 24 of one piece of material as well as increase the torsional strength of the rod 24. However, those of ordinary skill in the art will appreciate from this disclosure that the rod may be formed of multiple radially overlapping and/or axially side-by-side materials without departing from the scope of the present invention.

Referring generally to FIGS. 27-30 of an alternative embodiment of the present invention, the keyed rod 88 may comprise the first, keyed component 42 and the second, keyed component 62. Here, the keyed rod 88 may be preferably shaped like a spline and have teeth corresponding to a spline housing formed in the first, keyed receptacle 16, the second, keyed receptacle 60, and the connection housing inner surface 90. The keyed rod 88 with a spline shape may be, but is not necessarily, used to increase the friction and locking between corresponding components.

Figure 31:
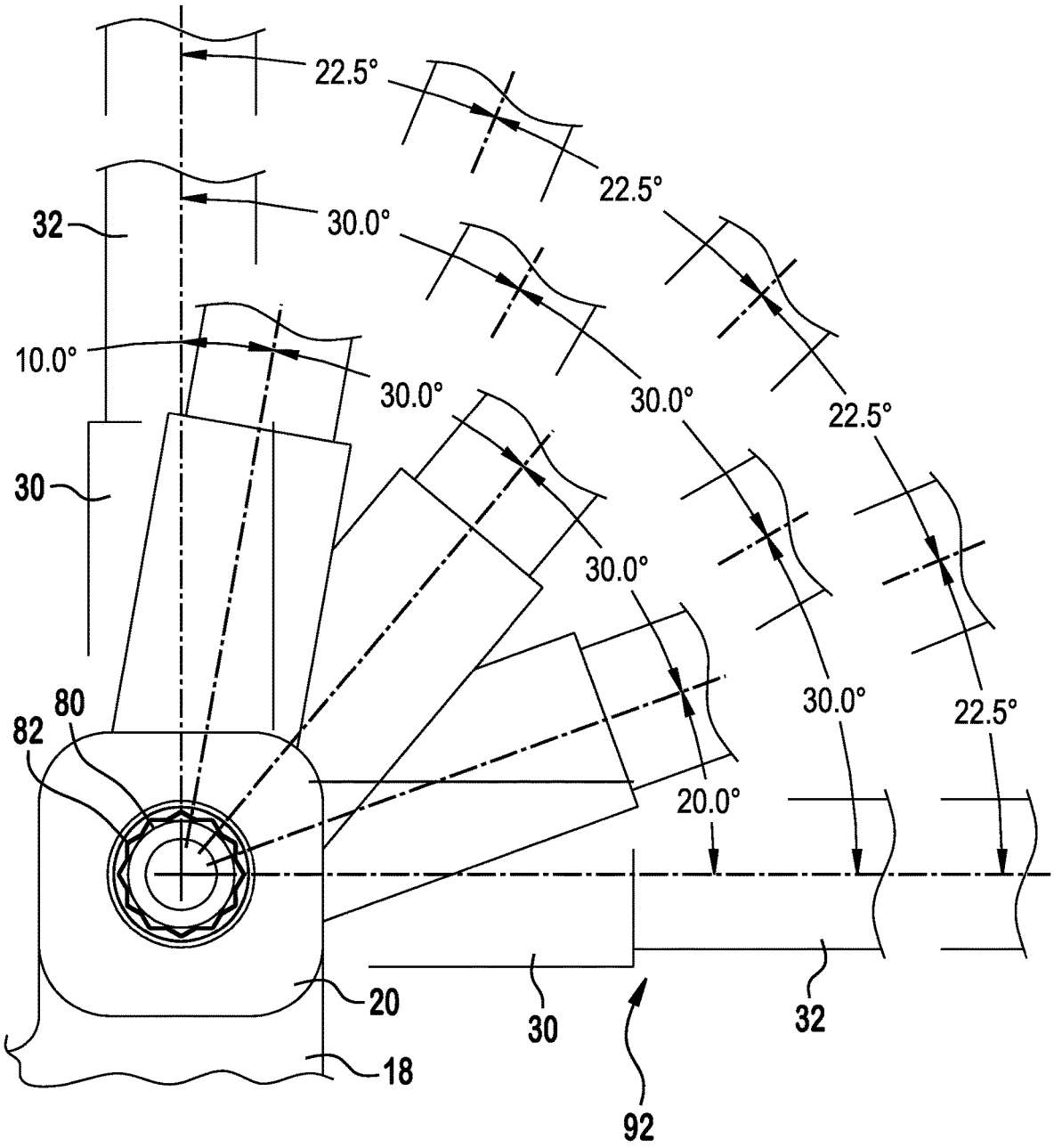
FIG. 31 is a side view of the hinge system 10 in the preferred embodiment. Here, any one of multiple in-use positions 92 can be seen. The any one of multiple in-use positions 92 preferably correspond to the various radial alignments that are possible by the engagement of the second keyed component, such as a nut or the like, 80 with the second keyed receptacle, such as a socket or the like, 82. While five in-use positions are shown, those of ordinary skill in the art will appreciate from this disclosure that any number of in use positions, such as for example two or ten or the like, can be used without departing from the scope of the present invention. Additionally, three different angular spacings are shown between the in-use positions. Some are evenly spaced others vary. However, those of ordinary skill in the art will appreciate from this disclosure that the angular spacings can be varied without departing from the scope of the present invention.

Referring now to FIG. 31 of the preferred embodiment of the present invention, any one of multiple in-use positions 92 are shown. When the nut 80 is disengaged from the socket 82, the chair back frame 26 may be rotated freely about the longitudinal axis L. The any one of multiple in-use positions 92 may only be limited by the number of possible points within the socket 82. For example, a socket 82 with twelve (12) points may allow up to twelve (12) in-use positions, each position at thirty degrees (30°) from the preceding, or next, in-use position, or a socket 82 with sixteen (16) points may allow up to sixteen (16) in-use positions, each position at twenty-two and one-half degrees (22.5°) from the preceding, or next, in-use position. One of ordinary skill in the art would appreciate from this disclosure that any suitable number of points within the socket 82 may used that still allow for the rigid locking of the keyed components 42, 62 with the keyed receptacles 16, 60 without departing from the scope of the present invention.

Figure 32:
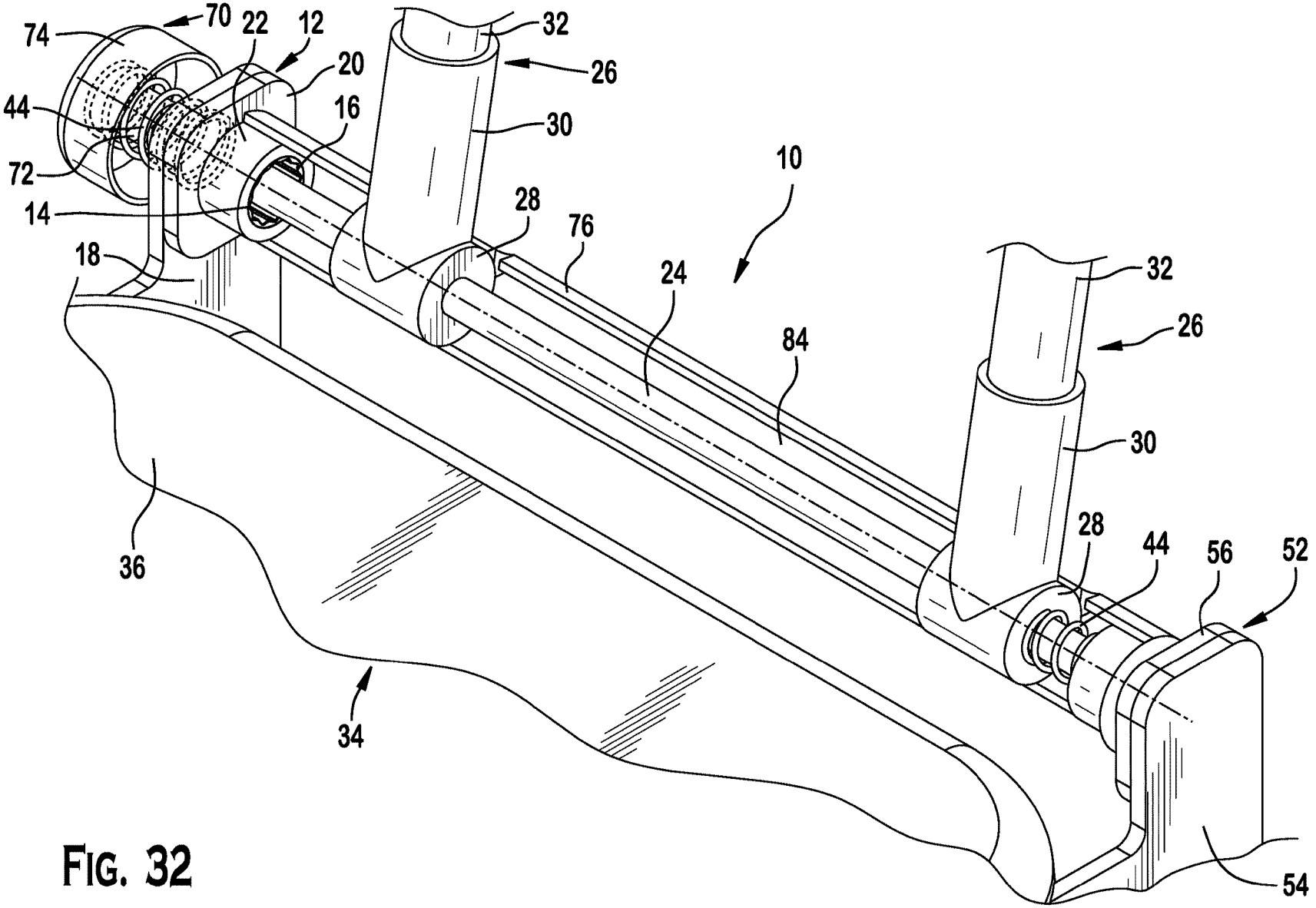
FIG. 32 is a partial, cut-away front perspective view of a hinge system 10 in an alternative preferred embodiment.

Referring now to FIG. 32 of an alternative preferred embodiment of the present invention, a hinge system 10 may be seen. Here, the biasing member may comprise a first biasing member 122 having a first biasing axial end 123 and a second biasing member 124 having a second biasing axial end 125. The first biasing member 122 may be located axially between the first hinge housing 12 and the knob 70 with the first biasing axial end 123 located adjacent to the first hinge housing 12. The second biasing member 124 may be located axially between the second hinge housing 52 and the chair back connector 28 with the second biasing axial end 125 located adjacent to the second hinge housing 52. A biasing member 44 comprising a first biasing member 122 and a second biasing member 124 may be advantageous to increase the biasing force of the biasing member 44 as well as reduce the wear and tear on the hinge system 10.

One of ordinary skill in the art would appreciate from this disclosure that the various components and elements of the present invention may be constructed of any suitably strong, wear-resistant, flexible (where desired), and inexpensive metals, polymers, alloys, plastics, and other materials without departing from the scope of the present invention.

One of ordinary skill in the art will appreciate from this disclosure that device elements, as well as materials, shapes and dimensions of device elements, as well as methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention.

What is claimed is:

1. A hinge system, comprising:

a first hinge housing defining a first hole and configured to be disposed on a chair seat frame, the first hole forming a first, keyed receptacle;

a rod which is detachably engageable with the first hinge housing, the rod being configured to have a chair back frame disposed thereon, the rod being configured to define an axis of rotation about which the chair back frame and the chair seat frame move relative to each other;

a first, keyed component disposed on the rod which is configured to detachably engage the first, keyed receptacle;

a biasing member positioned on the rod and configured to drive the rod axially toward the first hinge housing such that the first, keyed component is biased toward engagement with the first, keyed receptacle;

wherein the biasing member can be moved between a first, biased position, in which the first, keyed component is driven toward engagement with the first, keyed receptacle, and a second, compressed position, in which the first, keyed component is driven toward disengagement with the first, keyed receptacle;

wherein the first, keyed component and the first, keyed receptacle are configured such that the rod can be secured to the first hinge housing in a plurality of angular positions, as measured in a cross-section taken perpendicular to the longitudinal axis, such that hinge system is configured to secure the chair back frame in any one of multiple in-use positions relative to the chair seat frame such that a user can vary an angle of reclination for sitting thereon.

2. The hinge system according to claim 1, wherein the first hinge housing defines a rotation chamber, the rotation chamber being contained at least partially within the first hinge housing, and the rotation chamber allowing free rotation of the first, keyed component to the any one of multiple in-use positions when the biasing member is in the second, compressed position.

3. The hinge system according to claim 1, further comprising:

a second hinge housing defining a second hole and configured to be disposed on the chair seat frame, the second hole forming a second, keyed receptacle; and a second, keyed component disposed on the rod which is configured to detachably engage the second, keyed receptacle;

wherein the biasing member can be moved between the first, biased position, in which the second, keyed component is driven toward engagement with the second, keyed receptacle, and the second, compressed position, in which the second, keyed component is driven toward disengagement with the second, keyed receptacle.

4. The hinge system according to claim 3, wherein the first hinge housing defines a rotation chamber, the rotation chamber being contained at least partially within the first hinge housing, and the rotation chamber allowing free rotation of the first, keyed component to the any one of multiple in-use positions when the biasing member is in the second, compressed position.

5. The hinge system of claim 4, wherein the first housing completely encloses the rotation chamber, the rotation chamber being configured to be located axially between the first, keyed receptacle and a closest axial end of the chair seat frame.

6. The hinge system according to claim 5, further comprising an elongated housing disposed between the first hinge housing and the second hinge housing, the elongated housing at least partially enclosing the rod.

7. The hinge system of claim 6, wherein the biasing member is located between the rod and the elongated housing.

8. The hinge system of claim 7, wherein the biasing member comprises a first biasing member and a second biasing member, the first biasing member having a first biasing axial end positioned adjacent to the first, keyed receptacle, the second biasing member having a second biasing axial end positioned adjacent to the second, keyed receptacle.

9. The hinge system of claim 6, wherein the elongated housing defines at least one slot configured to allow passage of a chair back frame connector therethrough.

10. The hinge system according to claim 1, further comprising a knob, the knob being attached to a distal end of the rod, and the knob allowing the user to both convert the biasing member from the first, biased position to the second, compressed position and rotate the rod to the any one of multiple in-use positions.

11. The hinge system of claim 10, wherein the biasing member is located between the knob and the first hinge housing.

12. The hinge system according to claim 1, wherein the rod forms the first, keyed component.

13. The hinge system according to claim 1, wherein the first, keyed component is selected from a group comprising one of a nut, a spline shaft, a gear, and a ratchet.

14. The hinge system according to claim 1, wherein the first, keyed receptacle is selected from a group comprising one of a socket, a spline hub, a gear housing, and a pawl.

15. A chair, comprising:

a chair back frame;

a chair seat frame; and a first hinge housing defining a first hole and disposed on the chair seat frame, the first hole forming a first, keyed receptacle;

a rod which is detachably engageable with the first hinge housing, the rod having the chair back frame located thereon, the rod being configured to define an axis of rotation about which the chair back frame and the chair seat frame move relative to each other;

a first, keyed component disposed on the rod which is configured to detachably engage the first, keyed receptacle;

a biasing member positioned on the rod and configured to drive the rod axially toward the first hinge housing such that the first, keyed component is biased toward engagement with the first, keyed receptacle;

wherein the biasing member can be moved between a first, biased position, in which the first, keyed component is driven toward engagement with the first, keyed receptacle, and a second, compressed position, in which the first, keyed component is driven toward disengagement with the first, keyed receptacle;

wherein the first, keyed component and the first, keyed receptacle are configured such that the rod can be secured to the first hinge housing in a plurality of angular positions, as measured in a cross-section taken perpendicular to the longitudinal axis, such that the chair back frame can be positioned in any one of multiple in-use positions relative to the chair seat frame such that a user can vary an angle of reclination for sitting thereon.

16. The chair of claim 15, further comprising:

a second hinge housing defining a second hole and configured to be disposed on the chair seat frame, the second hole forming a second, keyed receptacle; and a second, keyed component disposed on the rod which is configured to detachably engage the second, keyed receptacle;

wherein the biasing member can be moved between the first, biased position, in which the second, keyed component is driven toward engagement with the second, keyed receptacle, and the second, compressed position, in which the second, keyed component is driven toward disengagement with the second, keyed receptacle; and the first hinge housing defines a rotation chamber, the rotation chamber being contained at least partially within the first hinge housing, and the rotation chamber allowing free rotation of the first, keyed component to the any one of multiple in-use positions when the biasing member is in the second, compressed position.

17. The chair of claim 16, further comprising an elongated housing disposed between the first hinge housing and the second hinge housing, the elongated housing at least partially enclosing the rod; wherein the elongated housing defines at least one slot configured to allow passage of a chair back frame connector therethrough.

18. The chair of claim 17, wherein the rod forms the first, keyed component.

19. The chair of claim 17, further comprising a knob, the knob being attached to a distal end of the rod, and the knob allowing the user to both convert the biasing member from the first, biased position to the second, compressed position and rotate the rod to the any one of multiple in-use positions, wherein the biasing member is located between the knob and the first hinge housing.

20. The chair of claim 17, wherein the first, keyed component is selected from a group comprising one of a nut, a spline shaft, a gear, and a ratchet.

* * * * *